US009556632B2

(12) United States Patent
Malakauskas et al.

(10) Patent No.: US 9,556,632 B2
(45) Date of Patent: Jan. 31, 2017

(54) METHOD AND SYSTEM FOR CONSTRUCTION OF A BUILDING

(71) Applicant: Vastint Hospitality B.V., Amsterdam Zuidooost (NL)

(72) Inventors: Giedrius Malakauskas, Amsterdam (NL); Marius Baltramiejunas, Amstelveen (NL); Harald Dieter Muller, Gdansk (PL); Erik Roger Andersson, Konstancin Jeziorna (PL); Thomas Hattig, Berlin (DE); Steen Torben Sodemann, Leuven (BE); Philip Muller, Gdansk (PL)

(73) Assignee: Vastint Hospitality B.V., Amsterdam, Zuidoost (NL)

( * ) Notice: Subject to any disclaimer, the term of this patent is extended or adjusted under 35 U.S.C. 154(b) by 0 days.

(21) Appl. No.: 14/373,722

(22) PCT Filed: Jan. 22, 2013

(86) PCT No.: PCT/EP2013/051155

§ 371 (c)(1),
(2) Date: Jul. 22, 2014

(87) PCT Pub. No.: WO2013/110616

PCT Pub. Date: Aug. 1, 2013

(65) Prior Publication Data

US 2014/0352232 A1 Dec. 4, 2014

Related U.S. Application Data

(60) Provisional application No. 61/589,626, filed on Jan. 23, 2012, provisional application No. 61/589,635, filed on Jan. 23, 2012.

(30) Foreign Application Priority Data

Jan. 23, 2012 (SE) ..... 1250043
Jan. 23, 2012 (SE) ..... 1250044

(51) Int. Cl.
*E04H 1/00* (2006.01)
*E04B 1/348* (2006.01)
(Continued)

(52) U.S. Cl.
CPC ..... *E04H 1/005* (2013.01); *E04B 1/348* (2013.01); *E04B 1/34838* (2013.01);
(Continued)

(58) Field of Classification Search
CPC ..... E04B 1/66; E04B 1/74; E04B 1/348; E04B 1/34869; E04B 1/35; E04H 1/005
(Continued)

(56) References Cited

U.S. PATENT DOCUMENTS 2,089,059 A 8/1937 Harley
2,442,184 A 5/1948 Summers
(Continued)

FOREIGN PATENT DOCUMENTS

CA 2046217 1/1992
CH 688629 12/1997
(Continued)

OTHER PUBLICATIONS

International Search Report for International Application No. PCT/EP2013/051158 mailed Jun. 6, 2013 (2 pages).
(Continued)

*Primary Examiner* — Brent W Herring
(74) *Attorney, Agent, or Firm* — Merchant & Gould P.C.

(57) ABSTRACT

A method for providing at least a part of a building includes the steps of prefabricating a module by assembling four walls extending between a floor and a roof to form a rectangular cuboid shape; providing at least one compartment within the cuboid shape; providing waterproof layers on the interior walls and floor of the compartment for creating a wet area within the module; arranging technical
(Continued)

Fig. 26B installations within the cuboid shape; and providing interior equipment within the cuboid shape. The method further includes the steps of prefabricating a plurality of panels and slabs; and connecting these panels and slabs to a lateral side of the module for providing a further rectangular cuboid shape forming a panel-built room.

64 Claims, 27 Drawing Sheets

(51) Int. Cl.
*E04B 1/66* (2006.01)
*E04B 1/74* (2006.01)
*E04B 1/35* (2006.01)

(52) U.S. Cl.
CPC ..... *E04B 1/34869* (2013.01); *E04B 1/66* (2013.01); *E04B 1/74* (2013.01); *E04B 1/35* (2013.01)

(58) Field of Classification Search
USPC ..... 52/79.9, 745.2, 741.4, 745.16, 745.06,52/745.13, 745.02
See application file for complete search history.

(56) References Cited

U.S. PATENT DOCUMENTS 2,825,098 A 4/1958 Hultquist
2,891,638 A 6/1959 Grundy
3,047,106 A 7/1962 Callahan
3,238,346 A 3/1966 Savko
3,462,891 A 8/1969 Smith
3,492,767 A 2/1970 Pincus
3,503,170 A 3/1970 Shelley
3,510,997 A 5/1970 Ratych
3,550,334 A * 12/1970 Van Der Lely ..... B28B 7/22 52/185
3,577,672 A 5/1971 Nutting
3,585,767 A 6/1971 Wilk et al.
3,593,469 A 7/1971 Wall
3,623,296 A 11/1971 Santoro
3,643,390 A 2/1972 Shelley
3,656,266 A 4/1972 Tylius
3,691,003 A * 9/1972 Elischer ..... B28B 11/04 156/304.3
3,694,977 A * 10/1972 Verman ..... E04B 1/34823 52/79.13
3,727,753 A * 4/1973 Starr ..... E03C 1/01 206/223
3,742,660 A 7/1973 Bierweiler
3,750,366 A * 8/1973 Rich, Jr. ..... E04B 1/34807 52/79.11
3,793,796 A * 2/1974 Hughes ..... E04B 1/3483 52/79.8
3,828,502 A 8/1974 Carlsson
3,831,327 A 8/1974 McCrillis et al.
3,858,846 A 1/1975 Schmid
3,862,534 A 1/1975 Coletti
3,866,672 A * 2/1975 Rich, Jr. ..... F24F 3/044 165/50
3,894,373 A * 7/1975 Willingham ..... E04B 1/34823 52/236.3
3,921,355 A * 11/1975 Pennecot ..... E04B 1/20 52/262
3,971,867 A * 7/1976 Randall ..... B32B 21/10 181/290
3,990,193 A * 11/1976 Ray ..... E04B 1/34823 52/745.03
4,118,905 A * 10/1978 Shelley ..... E04B 1/34823 52/236.4
4,147,926 A 4/1979 Stähli
4,176,274 A 11/1979 Lippera
4,212,405 A * 7/1980 Schmidt ..... B62D 29/008 220/1.5
4,231,199 A * 11/1980 Gomez ..... E04B 1/04 52/204.2
4,238,858 A 12/1980 Maihart
4,267,769 A 5/1981 Davis
4,324,605 A * 4/1982 Bethea ..... A47K 3/001 156/247
4,327,529 A 5/1982 Bigelow, Jr. et al.
4,364,206 A * 12/1982 Wybauw ..... E04B 1/3483 52/185
4,439,957 A * 4/1984 Raasakka ..... E04B 1/34838 52/210
4,501,098 A 2/1985 Gregory
4,513,545 A * 4/1985 Hopkins, Jr. ..... 52/79.1
4,525,975 A * 7/1985 McWethy ..... E04B 1/34823 52/234
4,599,829 A * 7/1986 DiMartino, Sr. ..... E04B 1/3483 410/79
4,634,040 A 1/1987 Savard
D295,734 S 5/1988 Barber et al.
4,745,712 A * 5/1988 O'Leary ..... E04B 1/35 4/663
4,748,777 A * 6/1988 Glassco ..... E04C 2/16 52/82
4,788,802 A * 12/1988 Wokas ..... 52/79.1
4,879,850 A * 11/1989 Glassco ..... E04C 2/16 52/234
D334,985 S 4/1993 D'Agostino et al.
5,233,808 A 8/1993 Salmenmaki et al.
5,305,568 A * 4/1994 Beckerman ..... B32B 3/00 428/116
5,345,779 A * 9/1994 Feeney ..... E04F 15/02411 361/695
5,438,713 A * 8/1995 Clarke ..... E03C 1/01 4/640
5,706,614 A * 1/1998 Wiley, Jr. ..... E04B 1/3483 52/537
5,724,773 A 3/1998 Hall
5,778,607 A * 7/1998 Edwards ..... B08B 15/02 454/230
5,797,440 A 8/1998 Tsai
D408,332 S 4/1999 Leoni
5,930,960 A 8/1999 Konnerth
6,014,842 A * 1/2000 Matsubara ..... E04B 5/14 446/115
6,050,033 A 4/2000 Wrightman
D426,644 S 6/2000 Reiber et al.
6,164,106 A 12/2000 Nghiem et al.
6,195,950 B1 * 3/2001 Harris ..... E04B 1/10 52/270
6,393,774 B1 5/2002 Fisher
6,438,903 B1 8/2002 Weiss
6,510,659 B2 * 1/2003 Boyer et al. ..... 52/79.5
6,534,143 B1 3/2003 Thoma
6,581,982 B1 6/2003 Nghiem
6,616,390 B1 9/2003 Feilner
6,699,575 B1 * 3/2004 Dagher ..... B32B 5/14 428/114
6,854,218 B2 2/2005 Weiss
6,951,079 B2 10/2005 Weiss
7,004,455 B2 2/2006 Pilja
7,327,529 B2 * 2/2008 Seo ..... G11B 15/6656 360/85
7,520,102 B1 4/2009 diGirolamo et al.
D596,313 S 7/2009 Perrine
7,941,975 B2 5/2011 Ingjaldsdottir et al.
D655,019 S 2/2012 Colless et al.
8,291,647 B2 * 10/2012 Esposito ..... E04B 1/34331 52/11
8,747,987 B2 * 6/2014 Yu ..... B27D 1/04 144/352
8,869,465 B2 * 10/2014 McDougall ..... 52/92.2
8,875,445 B2 11/2014 Lippert
2001/0047628 A1 * 12/2001 Mouton ..... E04B 1/3483 52/144

(56) References Cited

U.S. PATENT DOCUMENTS

| | | | | |
|---|---|---|---|---|
| 2002/0059763 | A1* | 5/2002 | Wong | E04B 1/34869 52/378 |
| 2003/0033769 | A1* | 2/2003 | Record | E04B 1/14 52/270 |
| 2003/0107471 | A1 | 6/2003 | Tsubone | |
| 2003/0150178 | A1* | 8/2003 | Bergman | E04H 1/04 52/234 |
| 2004/0226238 | A1 | 11/2004 | Haapiainen | |
| 2005/0108957 | A1 | 5/2005 | Quesada | |
| 2006/0059792 | A1* | 3/2006 | Tiramani | E04B 1/3442 52/79.1 |
| 2006/0179749 | A1 | 8/2006 | Brandt | |
| 2007/0163184 | A1 | 7/2007 | Olesch | |
| 2007/0200342 | A1 | 8/2007 | Roberts-Moore et al. | |
| 2007/0245640 | A1* | 10/2007 | Bergqvist | E02D 5/56 52/92.2 |
| 2007/0271857 | A1* | 11/2007 | Heather | B65D 88/005 52/79.9 |
| 2008/0134589 | A1* | 6/2008 | Abrams | E04B 1/003 52/79.1 |
| 2008/0202048 | A1* | 8/2008 | Miller | E04B 1/3442 52/281 |
| 2008/0213040 | A1 | 9/2008 | Morze-Reichartz | |
| 2008/0245017 | A1* | 10/2008 | Hawes | E04B 1/24 52/506.02 |
| 2009/0113814 | A1* | 5/2009 | Rivera Ramos | E04B 1/34823 52/79.9 |
| 2009/0205277 | A1 | 8/2009 | Gibson | |
| 2009/0293396 | A1* | 12/2009 | Porter | E04B 1/14 52/309.3 |
| 2010/0126082 | A1 | 5/2010 | McLuskey | |
| 2010/0135746 | A1 | 6/2010 | Taneichi | |
| 2010/0283236 | A1 | 11/2010 | Sudar | |
| 2011/0023383 | A1* | 2/2011 | Brouillard | B28B 1/002 52/79.9 |
| 2011/0056147 | A1* | 3/2011 | Beaudet | E04B 1/3483 52/79.9 |
| 2011/0088333 | A1 | 4/2011 | Damichey | |
| 2011/0162293 | A1* | 7/2011 | Levy | E04B 1/3483 52/79.9 |
| 2011/0265396 | A1* | 11/2011 | Heather | B65D 90/0013 52/79.9 |
| 2011/0296769 | A1* | 12/2011 | Collins | E04B 1/003 52/79.1 |
| 2012/0023837 | A1* | 2/2012 | Eisenbeisz | E04H 1/02 52/79.5 |
| 2012/0047821 | A1* | 3/2012 | Bowron | E04B 1/34815 52/126.5 |
| 2013/0036702 | A1* | 2/2013 | Pacetti | E04H 1/1205 52/653.2 |
| 2013/0133272 | A1* | 5/2013 | Desormeaux | E04B 1/3483 52/79.1 |
| 2013/0152485 | A1* | 6/2013 | Austin | E04B 1/348 52/79.8 |
| 2013/0239487 | A1* | 9/2013 | Ingjaldsdottir | E04C 2/384 52/79.1 |
| 2013/0305629 | A1* | 11/2013 | Stephenson | E04B 1/3483 52/79.9 |
| 2015/0013240 | A1 | 1/2015 | Malakauskas et al. | |
| 2015/0240475 | A1 | 8/2015 | Malakauskas et al. | |

FOREIGN PATENT DOCUMENTS

| | | |
|---|---|---|
| CN | 101967851 | 2/2011 |
| DE | 3744017 | 7/1989 |
| DE | 93 13 274 | 11/1993 |
| DE | 9314567 U1 | 3/1994 |
| DE | 9400057 U1 | 4/1994 |
| DE | 102005044980 | 3/2007 |
| DE | 19704824 | 10/2007 |
| DE | 202006007316 U1 | 10/2007 |
| DE | 202007009528 U1 | 12/2008 |
| DE | 102007037436 | 2/2009 |
| DE | 102007057003 | 5/2009 |
| DE | 102007057291 | 6/2009 |
| DE | 102008061009 | 6/2010 |
| EP | 0320381 A1 | 6/1989 |
| EP | 0 462 790 | 12/1991 |
| EP | 0 467 191 | 2/1992 |
| EP | 0565 842 | 10/1993 |
| EP | 1 039 056 | 9/2000 |
| EP | 1 088 943 | 4/2001 |
| EP | 0 772 719 | 8/2001 |
| EP | 1 126 091 | 8/2001 |
| EP | 1 254 289 | 8/2001 |
| EP | 0 879 118 | 11/2001 |
| EP | 1 042 630 | 6/2002 |
| EP | 0 913 612 | 4/2003 |
| EP | 1 369 636 | 12/2003 |
| EP | 1 403 441 | 3/2004 |
| EP | 1 740 787 | 10/2005 |
| EP | 1 863 980 | 10/2006 |
| EP | 1 899 542 | 12/2006 |
| EP | 1 764 447 | 3/2007 |
| EP | 1 733 100 | 1/2009 |
| EP | 2 537 999 | 12/2012 |
| GB | 569053 | 5/1945 |
| GB | 1 213 009 | 11/1970 |
| KR | 2009 0130562 | 12/2009 |
| NL | 6903809 | 9/1969 |
| SE | 324340 | 5/1970 |
| WO | WO 96/36777 | 11/1996 |
| WO | WO 97/28929 | 8/1997 |
| WO | WO 98/38395 | 9/1998 |
| WO | WO 99/23406 | 5/1999 |
| WO | WO 00/34593 | 6/2000 |
| WO | WO 01/55517 | 8/2001 |
| WO | WO 02/081831 | 10/2002 |
| WO | WO 2004/048710 | 6/2004 |
| WO | WO 2004/067868 | 8/2004 |
| WO | WO 2004/099519 | 11/2004 |
| WO | WO 2005/088021 | 9/2005 |
| WO | WO 2005/093185 | 10/2005 |
| WO | WO 2006/103033 | 10/2006 |
| WO | WO 2006/119517 | 11/2006 |
| WO | WO 2006/136853 | 12/2006 |
| WO | WO 2008/102152 | 8/2008 |
| WO | WO 2008/004896 | 10/2008 |
| WO | WO 2008/143496 | 11/2008 |
| WO | WO 2009/154387 | 12/2009 |
| WO | WO 2010/001719 | 1/2010 |
| WO | WO 2010/008295 | 1/2010 |
| WO | WO 2010/018267 | 2/2010 |
| WO | WO 2011/039439 | 4/2011 |
| WO | WO 2011/102332 | 8/2011 |
| WO | WO 2011/117675 | 9/2011 |
| WO | WO 2011/123873 | 10/2011 |

OTHER PUBLICATIONS

International Search Report for International Application No. PCT/EP2013/051157 mailed May 28, 2013 (3 pages).

International Search Report for International Application No. PCT/EP2013/051155 mailed Jun. 20, 2013 (3 pages).

* cited by examiner

Fig. 43A-D

METHOD AND SYSTEM FOR CONSTRUCTION OF A BUILDING

This application is a National Stage Application of PCT/EP2013/051155, filed 22 Jan. 2013, which claims benefit of Serial No. 1250043-5, filed 23 Jan. 2012 in Sweden; Serial No. 1250044-3, filed 23 Jan. 2012 in Sweden; Ser. No. 61/589,626, filed 23 Jan. 2012 in the United States; and Ser. No. 61/589,635, filed 23 Jan. 2012 in the United States and which applications are incorporated herein by reference. To the extent appropriate, a claim of priority is made to each of the above disclosed applications.

TECHNICAL FIELD

The present invention relates to building systems, and in particular to methods for constructing buildings by means of prefabricated elements.

BACKGROUND

It is today a known procedure to use different kinds of prefabricated elements when erecting a building complex. Already in the 1960's, and perhaps even before that, the concept of building prefabricated modules was used. The modules could e.g. include a bathroom, a kitchen or the like. This module would then be compatible to be installed in a building complex; cf. for instance GB-A-1,213,009.

EP-A-462,790 discloses a building system which comprises rooms formed from prefabricated room units, wherein the units include walls and a ceiling. The room units are arranged in rows where each row has adjacent pairs of room units and where each pair of units is structural mirror images of each other. Even though the elements are prefabricated there is still a lot of work to be done with the interior before the building may be ready to use as e.g. a hotel. The work at the construction site is time-consuming and expensive since many workers must be hired to finish the interiors. Hence, this known system involves high costs which probably is the main reason why it has not been put into practice.

US-A-2005/0108957 describes a prefabricated module which is intended to be used in a multi-storey building. The modules may contain a bathroom, a kitchen, a staircase or a combination of the previous mentioned and may be stacked on top of each other and then installed concurrently with the surrounding structure. One module may be configured to have a dual room layout which means that the module will include e.g. two bathrooms which are a mirror image of each other. Additionally, each module has a vertical shaft which includes features like water supply, waste sewage and ventilation shaft. This known system is complicated and suffers from the same problem as the costly system described above.

As to background art, WO-A-2006/13653 could be mentioned as well since it discloses a prefabricated service pod. However, this publication does not suggest low-cost prefabrication based on non-complex structures. Hence, the proposed service pods are not suitable for building projects of the type today's market demands.

Prefabricated elements for buildings do not only include service pods and the like, but also various types of wall and panel elements. An example of such an element is disclosed in EP-A-565,842. However, this known element only constitutes a part of a building and the publication does not suggest any overall solution to the problem of how to construct an entire building which meets today's requirements of low-cost construction projects to be performed under time pressure.

The choice of building method normally depends on which type of house to be built and for what purpose. Although known building methods may differ in many ways, most of them are time consuming. As construction time is a crucial factor for the cost efficiency of the building, there is always a need for improving the erecting methods, especially for large and complex buildings such as multi-resident buildings or the like.

WO-A-2008/102152 describes a method of constructing a building with prefabricated modules, wherein each module defines a room with e.g. a bathroom area. The modules may be identical or of two different types, and they are configured to be stacked upon each other to form a multi-storey building.

WO-A-00/34593 discloses a building method using two different kinds of modules, i.e. a U-shaped module and an L-shaped module. The modules are combined on site to form the bearing structure of a multi-storey building. Since the modules are not pre-fabricated there are many partial challenges with this building method. Particularly, the proposed building method is disadvantageous since all the different parts of the partial modules must be manufactured with high precision to fit each other. More parts and partial modules will increase the risk of making a mistake in the production or the assembly. Many parts of different sizes and shapes also become a problem when transporting them to the erection site. The space of the transportation may then not be optimized for the parts packed in it. The proposed method is thus not very flexible since the different shapes of the modules require specially adapted logistic resources.

Another example of a building method is described in CA-A-2,046,217. In this document a solution is proposed involving a building unit which comprises at least four dwelling units which are supposed to be connected to each other, horizontally or vertically. The dwelling units comprise modules which include different types of interior depending on its location and purpose.

In view of the building methods previously presented there is still a need for an improved method which allows a reduced erecting time.

SUMMARY

An object of the present invention is to provide a novel technique for constructing buildings which is improved over prior art.

A particular object is to provide a building method which is cost-effective compared to prior-art building methods.

An additional object is to provide a building method which allows a reduction of the on-site erection time.

A yet further object is to provide a versatile building method which may be used for providing a wide range of building designs and applications.

It is also an object of the present invention to overcome or at least mitigate the above-mentioned disadvantages by providing an improved building method which makes the onsite erection more efficient.

Another object of the present invention is to provide a building method which allows for a reduced need for on-site construction staff.

A further object of the present invention is to provide a building method which allows for improved quality of the building.

An additional object is to provide a building method which is optimized regarding logistics, and thus allows for an improved efficiency of transportation.

These objects have now been achieved by a technique having the features set forth in the appended independent claims. Preferred embodiments are defined in the dependent claims.

General Concept

An idea of general inventive concept is to combine the benefits of modular building techniques with the benefits of panel-based building techniques in a novel way in order to provide a building method which is highly advantageous over the known prior-art methods.

Another idea is to provide prefabricated modules manufactured according to industrial production processes, and to use such modules when constructing different types of buildings. Hence the modules, as well as the panels and slabs, may be manufactured by line production using a high level of automation.

A yet further idea is to provide a building method which is particularly advantageous for multi-resident buildings. Preferably, the building method is applied to multi-room buildings, in which each resident is occupying one of the rooms, such as hotels, student houses, hospitals, etc.

According to a first aspect, a method for providing at least a part of a building is provided. The method comprises the step of prefabricating a module by assembling four walls extending between a floor and a roof to form a rectangular cuboid shape, providing at least one compartment within said cuboid shape, providing waterproof layers on the interior walls and floor of said compartment for creating a wet area within said module, arranging technical installations within said cuboid shape, and providing interior equipment within said cuboid shape. The method also comprises the steps of prefabricating a plurality of panels and slabs, and connecting said plurality of panels and slabs to a lateral side of said module for providing said part of a building such that said lateral side of said module together with said plurality of prefabricated panels and slabs form a further rectangular cuboid shape.

The waterproof layers may be provided on parts of the interior wall and floor surfaces of the compartment within the module, or on the complete interior wall and floor surfaces of the compartment. Optionally, also the inner surface of the module ceiling may to at least some extent be covered by the waterproof layers.

The further rectangular cuboid shape mentioned above forms a room for a resident, for instance a student of a student home or a guest of a hotel, etc.

The step of prefabricating the module may further comprise providing interior partition walls for forming at least two compartments within the cuboid shape.

The step of providing interior partition walls may be performed such that two separated compartments are formed, and wherein each one of said compartments is ready to be occupied by its own resident. This is advantageous in that a single module may comprise the necessary wet areas for two rooms, each one of the room being provided for its own resident.

The interiors of the two separated compartments may be symmetrical along a centre line of said module. Hence, the manufacturing cost of the entire module is reduced.

The module may be formed with dimensions of approximately 6.5-7.0 m in length, about 2.5 m in depth, and about 3.0 m in height. Such dimensions are particularly advantageous due to logistics reasons, since the dimensions correspond to the normal loading capacity of a trailer. Thus, a truck may carry a number of modules put on a connected trailer from the manufacturing site to the building site with a minimum of unused loading capacity. Preferably, the modules are designed in such a way that two modules can be carried on a standard trailer.

The method may further comprise the step of providing said four walls, floor, and roof by arranging a planar wooden core adjacent to at least one insulating layer for each one of said walls, roof, and floor. For the construction of multi-resident buildings, the choice of wood, and in particular cross-laminated timber, has proven to be preferred due to material characteristics and cost effectiveness.

The method may further comprise the step of providing said insulating layer as a multi-layer structure comprising an inner layer of acoustic damping material and/or fire resistant material, optionally heat insulation material, and an outer layer, preferably of gypsum board. Hence, a very robust and safe construction is provided.

The step of prefabricating the module by assembling four walls extending between a floor and a roof may be performed such that the upper edges of said four walls extend beyond the outer surface of the roof. This is advantageous in that a service space is provided on top of the module, which service space may be used to store and allow access to parts of the technical installations.

The step of prefabricating the module by assembling four walls extending between a floor and a roof may be performed such that the lower edges of said four walls extend beyond the outer surface of the floor. Also this is advantageous in that an additional service space is provided under the module.

The step of assembling four walls extending between a floor and a roof may further comprise providing at least one opening on the wall forming a part of the further rectangular cuboid shape, and at least one opening on the opposite wall of said module, said openings optionally being provided with doors. Thus, resident access to the interior of the module is provided in an easy manner.

The step of providing waterproof layers for creating said wet area within said module may be performed by covering a part of the interior sides of said walls and slabs with said waterproof interior layers. Hence, no additional structures are needed for providing the wet area which reduces the cost and complexity when manufacturing the module. Moreover, the waterproof interior layers are only provided where they are actually needed.

The step of providing waterproof interior layers for creating said wet area within said module may on the other hand be performed by covering the complete interior sides of said walls and slabs with said waterproof interior layers.

The step of providing waterproof interior layers is preferably performed by applying solid layers or liquid layers.

Preferably, the step of providing waterproof layers for creating said wet area within said module is performed by covering the complete, or a part of, the interior sides of said walls and slabs by applying solid or liquid waterproof interior layers.

The step of arranging technical installations within said cuboid shape may comprise arranging at least one ventilation duct, at least one mains electricity cable, at least one low voltage electrical cable optionally connected to at least one distribution board, at least one water supply pipe, at least one water sewage pipe; preferably also a water-based heating system, a cooling system, and/or a sprinkler system within said module. This is advantageous in that all necessary installations which may possible be needed are already provided for in the module, which makes the module completely finished and ready for the mounting and connection to the panels and slabs.

A coupling means end of at least one technical installation is preferably accessible in the area formed above the roof of said module, i.e. the service space above the module, or in the area formed below the floor of said module, i.e. the service space below the module.

The step of providing at least one compartment may be performed such that two major compartments are formed, and at least one shaft is formed for said technical installations. Thus, the technical installations are located at dedicated areas, whereby the interior of the major compartments, which will be occupied by residents, may be designed in a very attractive manner without any disturbing conduits, shafts, or the like.

At least one ventilation duct may extend within a first shaft, and preferably the at least one mains electricity cable, the at least one low voltage electrical cable, including the optional distribution board, the at least one water supply pipe, and the at least one water sewage pipe may extend within a second shaft. Such disposition of technical installations is very efficient and may provide easy access for service and maintenance of the technical installations. In an embodiment, said first and second shafts may be formed in a common space which for instance facilitates inspection and maintenance.

The step of providing interior equipment within said cuboid shape may comprise installing a bathroom and optionally a kitchenette in said module. Further, the step of providing interior equipment within said cuboid shape may comprise installing furniture and/or fixtures in the module. By having such equipment pre-installed, the quality of the equipment installations may be extremely high since it is made in an off-site factory. Further, the construction site building time is greatly reduced. In alternative embodiments, certain fixtures and/or pieces of furniture are pre-installed in an off-site factory and other fixtures/furniture pieces may be installed on site after construction of the building.

The method may further comprise the step of providing the module with at least one engagement means for later engagement with a prefabricated panel or slab or another prefabricated module by means of a connecting device. By having such engagement means pre-mounted to the module, the construction may be very precisely done thus increasing the quality of the building and facilitating the constructional work.

The step of prefabricating a plurality of panels and slabs may be performed by arranging a planar wooden core adjacent to at least one insulating layer for each one of said panels and slabs. Hence, the panels and slabs may be made in the same material as the walls of the module which reduces the amount of different equipment needed for manufacturing the necessary parts. Further, the panels and slabs may preferably be manufactured at the same facility manufacturing the module, whereby the entire logistics of the building method may be optimized.

As for the walls of the modules, the planar wooden core may be formed by cross-laminated timber, preferably glued or nailed. In certain circumstances, so-called wood welding may be used for obtaining suitable cross-laminated timber.

The method may further comprise the step of providing at least one of said insulating layers as a multi-layer structure comprising an inner layer of acoustic damping material and/or fire resistant material, optionally heat insulation material, and an outer layer, preferably of gypsum board.

Further, the method may comprise the step of providing hollow electrical cable guides within said panels and/or slabs. Thus, the panels and slabs are prepared to be mounted to the prefabricated modules, and they will provide a very efficient way of arranging the necessary installations to the room formed by said panels. Electrical cables as well as other technical installations needed in the panels/slabs may also be pre-installed in factory before delivery to the erection site.

The method may further comprise the step of providing said panels and slabs with at least one engagement means for later engagement with a prefabricated module or another prefabricated panel or slab by means of a connecting device. By having such engagement means pre-mounted to the panels and/or slabs, the panels and/or slabs may be very precisely done, thus increasing the quality of the building and facilitating the constructional work.

The step of connecting said plurality of panels and slabs to a lateral side of said module may be performed by connecting a first wall to one lateral side edge of said module, a second wall to another lateral side edge of said module, a third wall to the center portion of said module, a first floor slab to the first and third wall, respectively, a second floor slab to the second and third wall, respectively, a fourth wall to the free lateral edge portion of the first and third wall, respectively, a fifth wall to the free lateral edge portion of the second and third wall, respectively, a first roof slab to the free upper edge portions of the first and third wall, respectively, and a second roof slab to the free upper edge portions of the second and third wall, respectively. Hence, a two-room part of a building is provided, whereby the module is divided into two separate wet areas.

Said fourth wall and said fifth wall may be formed as one piece, or said fourth wall and/or said fifth wall may be formed as one piece with a wall arranged vertically aligned with said fourth or fifth wall. This is advantageous in cases where transportation and logistics allow for larger panels.

The step of connecting said plurality of panels and slabs to a lateral side of said module may comprise providing at least one static connector and at least one dynamic connector for connecting at least one of said panels and/or slabs to said module. This combination of one static and one dynamic connector has proven to be very efficient and provides a very robust connection while at the same time providing easy handling. By static connection is here generally meant interconnecting two or more building members by a kind of mechanically static engagement. By dynamic connection is here generally meant interconnecting two or more building members by pulling these together, so that the members are pressed against each other in a tight connection.

The method may further comprise the step of connecting at least two prefabricated modules to each other in the direction of the length of the modules and/or the step of connecting at least two prefabricated modules to each other in the direction of the height of the modules. Hence, the modules are provided as a back bone of an elongated building which is highly advantageous since the modules are including the wet areas and the technical installations. By having all the technical installations aligned, the pipes and conduits needed may be provided in a reliable and efficient manner.

The method may further comprise the step of vertical aligning a first module with an adjacent module by means of alignment recesses provided on the upper edge portion of said first module and corresponding alignment protrusions on the bottom edge portion of said adjacent module. By having such alignment protrusions and recesses prepared on the modules, a very accurate alignment may be achieved. The arrangement of the protrusions and recesses may also be interchanged, such that the alignment protrusions are provided on upper edge portion of the first module, and the alignment recesses are provided on the bottom edge portion of the adjacent module.

The alignment means, i.e. the protrusions and the corresponding recesses, also serve as stabilizing anchoring means contributing to stabilization of the entire building in case of strong winds, minor quakes, etc.

According to a second aspect, a method for constructing a multi-room building is provided. The method comprises the steps of: providing a first part of a building according to the first aspect, providing a corridor extending along one lateral side of said first part; and providing a second part of a building according to the first aspect, wherein said second part of said building is arranged on the opposite side of said corridor.

The method may further comprise the step of extending said multi-room building in a vertical direction such that each part of the building, provided according to the method of the first aspect, of a specific floor is vertically aligned with the underlying part of the building.

The method may further comprise the step of extending said multi-room building in a horizontal direction such that each part of the building, provided according to the method of the first aspect, of a first side of the corridor is aligned with a corresponding part of the building on the opposite side of the corridor.

According to a third aspect, a part of a building is provided. The part of the building comprises a prefabricated module having a rectangular cuboid shape formed by four walls extending between a floor and a roof, wherein said module comprises at least one compartment within said cuboid shape, waterproof interior layers on the interior walls and floor of said compartment for creating a wet area within said cuboid shape, technical installations within said cuboid shape, and interior equipment within said cuboid shape, and wherein said part of the building further comprises a plurality of prefabricated panels and slabs connected to a lateral side of said module such that said lateral side of said module together with said plurality of prefabricated panels and slabs form a further rectangular cuboid shape.

According to a fourth aspect, a multi-room building is provided. The building comprises a corridor extending horizontally, and at least a first part of a building according to the third aspect arranged on a first side of said corridor, and a second part of a building according to the third aspect arranged on the opposite side of said corridor, wherein said second part of the building is aligned with the first part of the building.

The multi-room building may further comprise additional parts of a building arranged on top of the parts of the building already provided such that a part of a building of a specific floor is vertically aligned with the underlying part of the building.

According to a fifth aspect, a method of constructing a multi-room building is provided. The method comprises the steps of providing prefabricated, ready-to-use modules with interior wet areas, pre-installed electrical cable guides, water supply and waste conduits, and ventilation ducts; providing prefabricated wall panels with pre-installed electrical cable guides; arranging the modules aligned; and forming rectangular panel-built rooms in connection with the modules, one wall of a module defining one side of each room and three prefabricated panels defining the three remaining sides of the room, such that said modules and panel-built rooms form at least one floor of said building.

The method may further comprise the step of arranging additional prefabricated modules on top of each other for forming a multi-floor building with panel-built rooms extending perpendicular from the aligned modules.

The methods previously mentioned may further comprise the step of providing façade cladding on the outer surface of said module and/or panels.

On Site Erection

An idea of the on-site part of the inventive concept is to provide a building method which makes use of a number of prefabricated modules, and a number of prefabricated panels and slabs. The modules, each comprising the wet areas of at least one associated room or apartment, are aligned horizontally and/or vertically to extend the multi-resident building. The building method is performed by extending the module array(s) in different directions at the same time, while the panels and slabs are connected to the modules as they are connected to the array(s). Hence, the building may be constructed extremely fast as several construction workers may work on different rooms at the same time.

According to a sixth aspect, a method for providing a multi-resident building is provided. The method comprises the step of prefabricating a plurality of modules, each of which by assembling four walls extending between a floor and roof to form a rectangular cuboid shape, providing at least one compartment within said cuboid shape, providing waterproof layers on the interior walls and floor of said compartment for creating a wet area within said module, arranging technical installations within said cuboid shape, and providing interior equipment within said cuboid shape. The method further comprises the steps of prefabricating a plurality of panels and slabs; distributing at least a part of said plurality of modules in a horizontal array such that at least a first wall of a module is arranged in close proximity to a first wall of an adjacent module; and for each module connecting at least a part of said plurality of panels and slabs to a lateral end of said module for providing a part of a building such that one wall of each module together with said prefabricated panels and slabs form a further rectangular cuboid shape.

The step of distributing said modules may be performed by arranging a first module at a central position, and subsequently extending the horizontal array in at least one direction from said first module. Hence, the building may be constructed at several positions on the erection site in parallel, thus reducing the required on-site construction time.

The method may further comprise arranging a second module in parallel with said first module at a predetermined distance, and extending a horizontal array in at least one direction from said second module such that said horizontal arrays are aligned to each other. Hence, a corridor is provided between the two horizontal arrays of the modules. This means that the building may be constructed in four directions at the same time. For this, the step of extending the horizontal array of modules may be performed in the at least two directions simultaneously.

The method may further comprise the step of distributing a further number of modules in a vertical array from said first and/or second module such that said vertical array corresponds to several floors of the multi-resident building. Thus, the building extends vertically as a multi-storey building.

The step of distributing a further number of modules in a vertical array may thus be performed before, simultaneously or after the step of distributing at least a part of said plurality of modules in a horizontal array.

The step of distributing at least a part of said plurality of modules in a horizontal array may be performed for several floors simultaneously.

The step of connecting at least a part of said plurality of panels and slabs to a lateral side of each module may be performed for at least two modules simultaneously. Hence, the rooms are sealed in a swift manner thus allowing for decreased constructional time on site.

The step of connecting at least a part of said plurality of panels and slabs to a lateral side of each module may be performed simultaneously in said at least two directions of the horizontal array.

The step of connecting at least a part of said plurality of panels and slabs to a lateral side of each module may further be performed simultaneously for at least two modules of the vertical array.

The method may further comprise the step of providing façade cladding on the outer surface of said module and/or panels.

Also, the method may further comprise the step of aligning a further module relative the first or second module by means of protrusions and corresponding recesses provided on the further module and the first or second module, respectively.

According to a seventh aspect, a method for constructing a building is provided. The method comprises the steps of providing a plurality of prefabricated modules, each module forming a rectangular cuboid shape having at least one compartment forming a wet area, and having interior equipment and technical installations pre-installed; providing a plurality of prefabricated panels and slabs; distributing at least a part of said plurality of modules in a horizontal array such that at least one wall of a module is arranged in close proximity to one wall of an adjacent module; and for each module connecting at least a part of said plurality of panels and slabs to a lateral side of said module for providing a part of a building such that one wall of each module together with said prefabricated panels and slabs form a further rectangular cuboid shape.

According to an eighth aspect, a building is provided which is built or erected by a method in accordance with the previous aspects.

In a preferred embodiment of this building the prefabricated modules, panels and slabs are connected by a number of static connectors and/or dynamic connectors or connecting units forming combinations of static and dynamic connectors.

The invention also concerns a kit of building components comprising: at least one prefabricated module, a number of prefabricated panels and slabs, and a number of connecting devices for connecting the building components.

In this context, a building is preferably a multi-room building for several residents. Such buildings may e.g. be a building including a large amount of student apartments, a hotel, a hospital, or similar types of buildings. Further, a part of a building should thus be understood as a part of such multi-resident building, which part corresponds to one apartment, one hotel room, one hospital room, etc.

By the expression rectangular cuboid shape is meant a box-like structure of general type.

BRIEF DESCRIPTION OF THE DRAWINGS

Embodiments of the present invention will be described in the following with reference to the accompanying, schematic drawings which illustrate non-limiting examples of the inventive concept.

FIG. 6).

FIG. 9).

FIG. 5).

FIG. 18).

FIG. 18).

DETAILED DESCRIPTION OF EMBODIMENTS

An illustrative example how the invention can be carried out is shown in the diagrammatical FIGS. 1-8.

Figure 1:
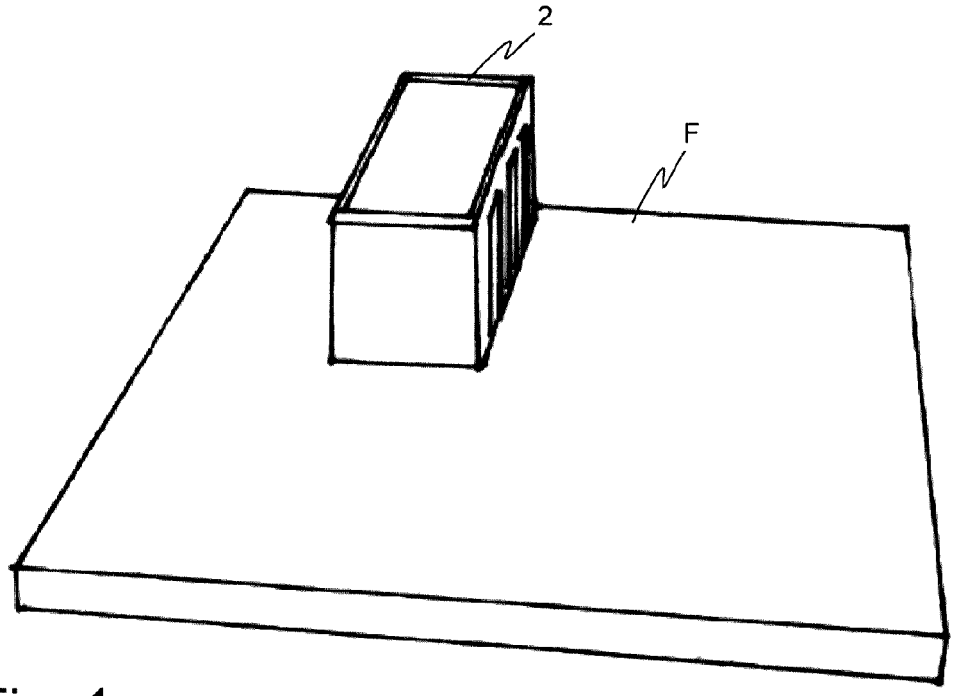
FIG. 1 shows a prefabricated module (so-called wet box) placed on a foundation in an initial step of constructing a building.
Figure 2:
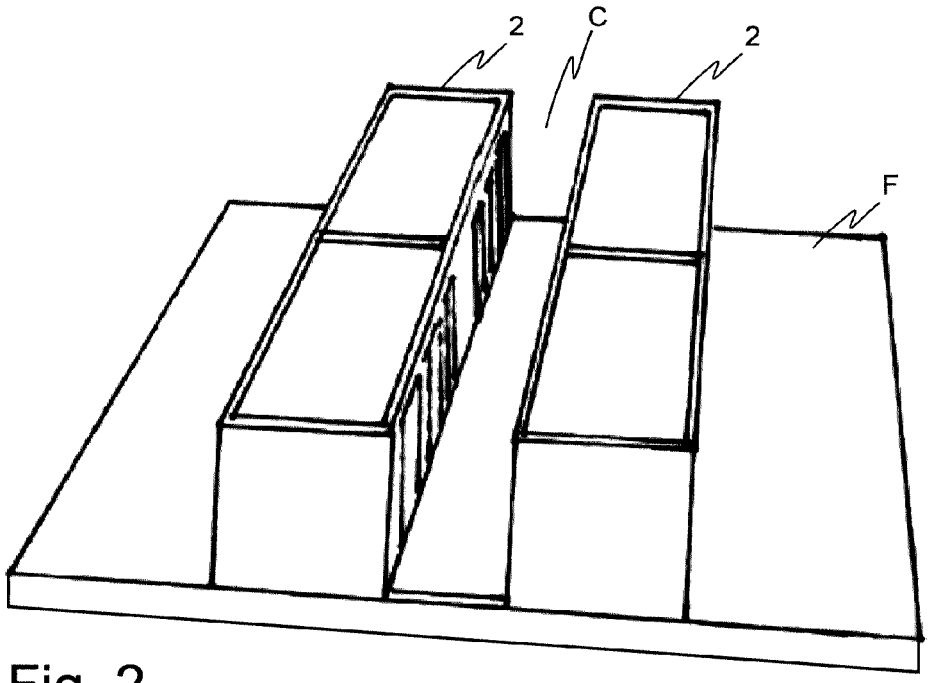
FIG. 2 shows how two arrays of modules are aligned on the foundation and spaced by a corridor.
Figure 3:
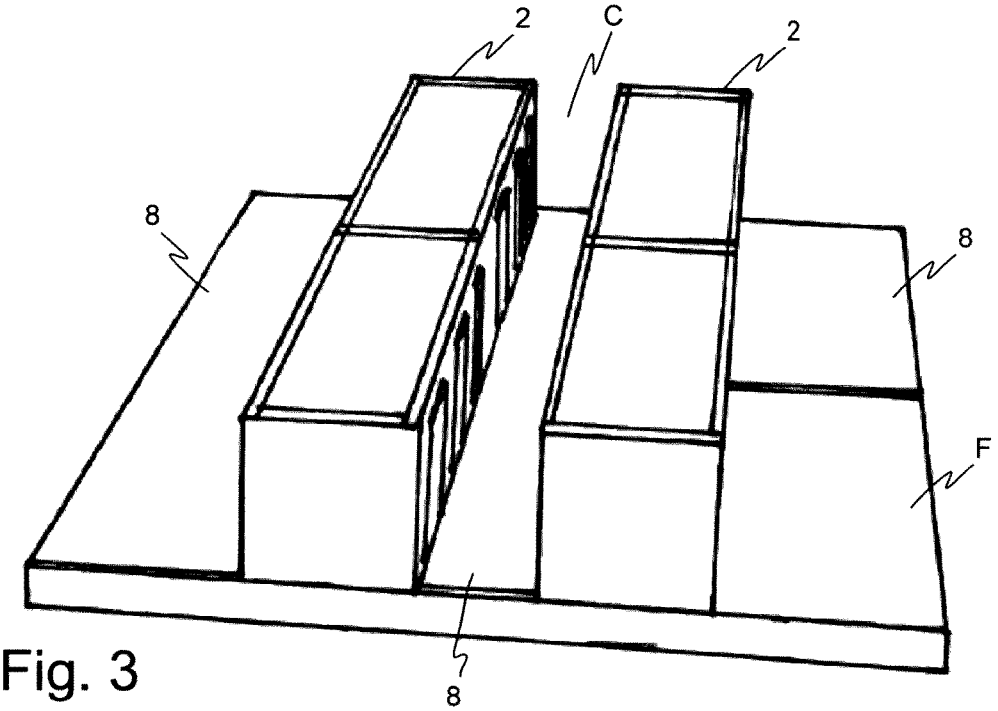
FIG. 3 shows how floor slabs are placed on the foundation thereby forming floors for the corridor as well as for rooms to be built outside the aligned modules.
Figure 4:
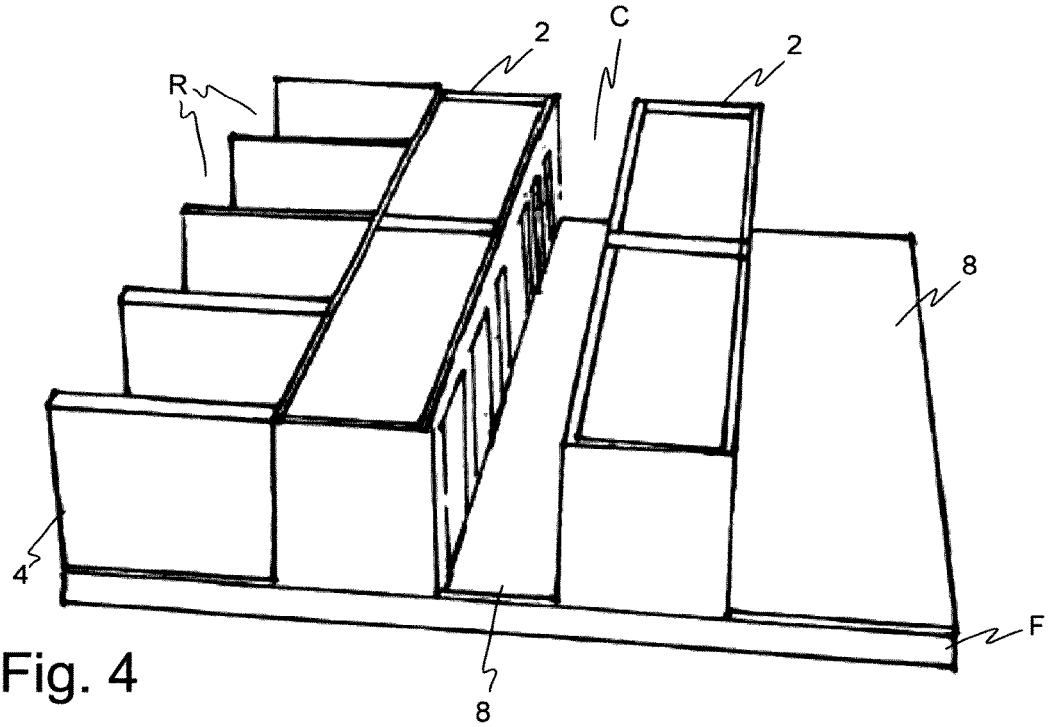
FIG. 4 shows how prefabricated wall panels are mounted vertically and connected to the left line of modules.
Figure 5:
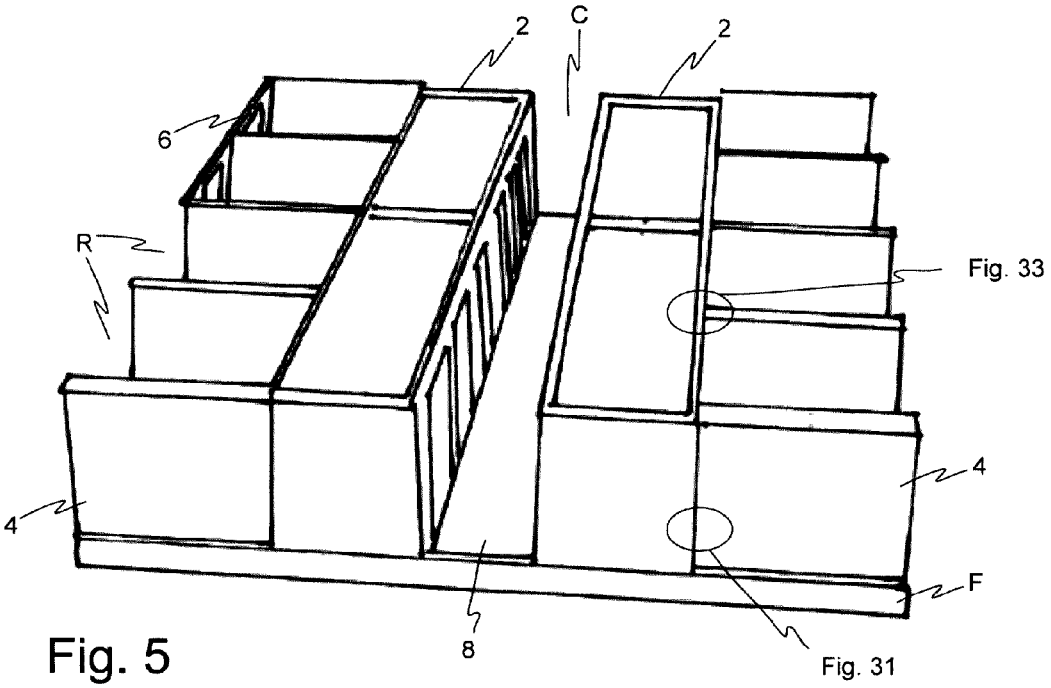
FIG. 5 shows how further wall panels are mounted vertically and connected to the right line of modules, whereas prefabricated facade panels are mounted in sequence to the wall panels of the left side of the building under construction.
Figure 6:
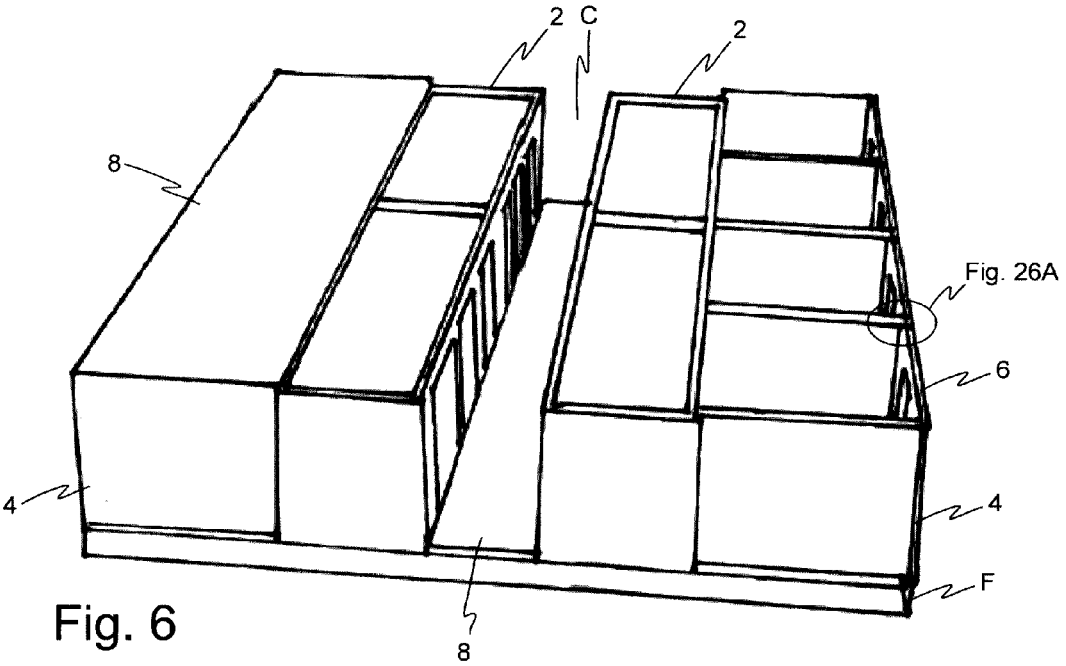
FIG. 6 show how upper slabs are mounted to vertical wall panels on the left side of the building thereby forming a group of rooms, whereas facade panels have been mounted to the wall panels on the right side of the building.
Figure 7:
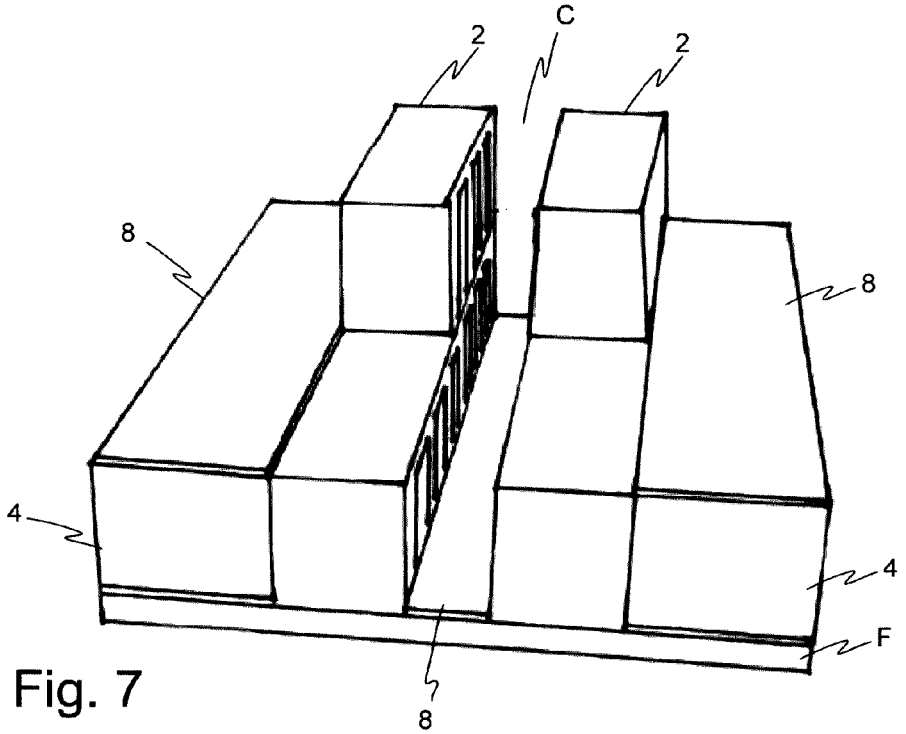
FIG. 7 shows a complete ground floor of the building and how a first floor is initiated by modules being placed on top of the lower modules.
Figure 8:
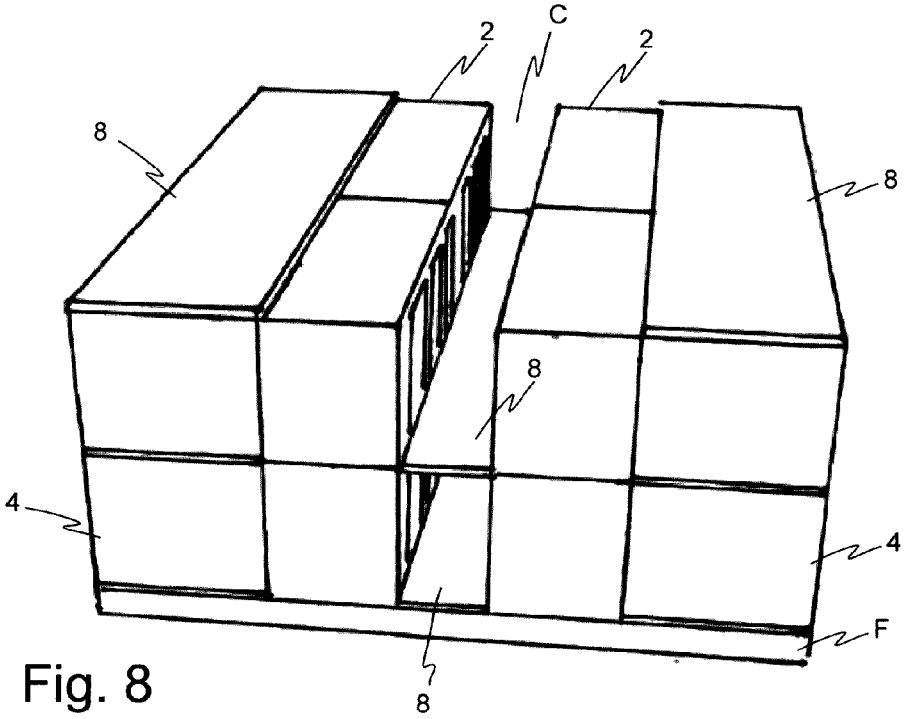
FIG. 8 shows the building with a complete ground floor and a complete first floor constructed by modules and panels.
Figure 9:
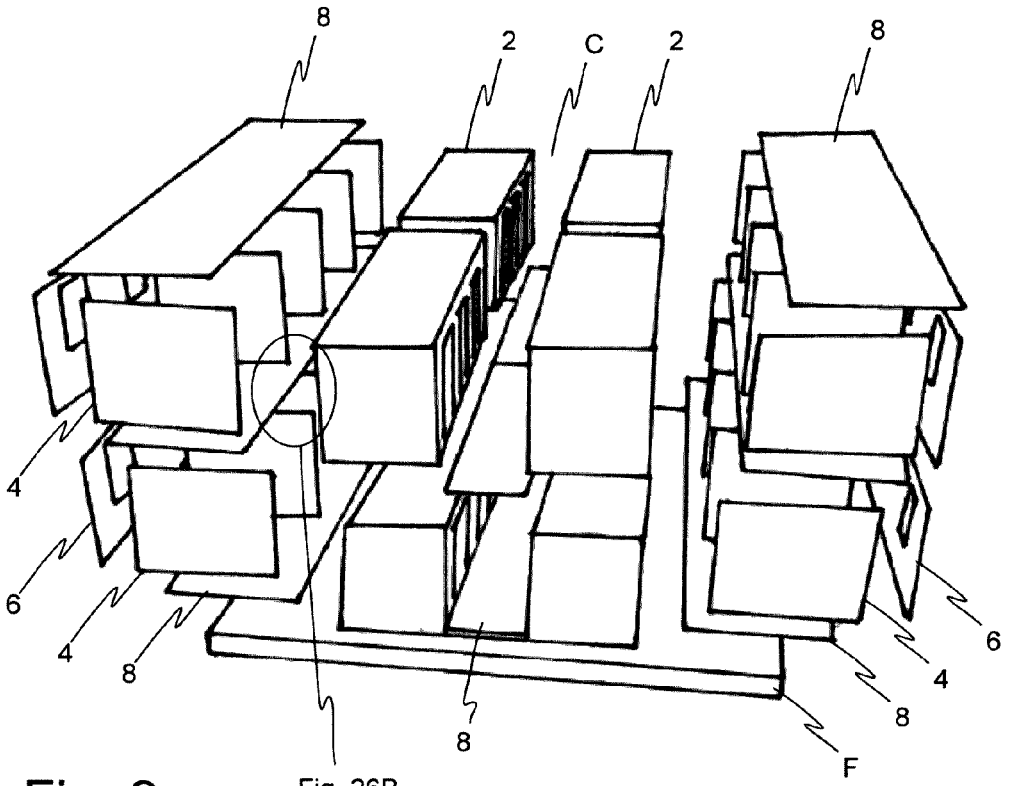
FIG. 9 is an exploded view of FIG. 8, where the elements are illustrated separately by way of illustration.

A building B according to an embodiment of the present invention is formed of a number of standardized elements (see FIG. 9). The main elements are prefabricated, box-like modules 2, prefabricated panels 4, 6 and prefabricated slabs 8. Each module 2 comprises at least a bathroom area and a service area. There are two general forms of panels 4, 6 where first panels 4 are to form inner walls and second panels 6 are to form outer walls. The panels 4 to form the inner walls are attached to the modules 2 and the panels 6 forming outer walls are attached to the panels 4 forming the inner walls. The slabs 8 are to form floors and roofs of box-like, panel-built rooms R. The slabs 8 may have a varying length. Preferably, the length of a slab 8 equals half the length of a module 2. However, the length of a slab 8 may also equal the length of a module, or multiples of such length.

In construction of a building B according to this concept, one starts with a first module 2 such that one lateral side of the first module 2 is in close proximity with a lateral side of an adjacent module 2. The two aligned modules must not necessarily be attached to each other by rigid fixtures, but may simply be put in close proximity to each other and secured in the correct position by means of alignment means provided on the lower side of the module facing the ground or foundation F, which optionally may have supporting structures, for instance of steel or concrete (not shown). In the shown example the modules 2 are placed in two spaced-apart rows, forming a corridor C between the two rows of modules 2. In order to make benefit of the corridor C the modules are provided with at least one door opening facing the corridor C (see FIGS. 16-17).

In a next step slabs 8 are attached to the modules 2 to form floors in the corridor C and in the rooms R to be formed. Thereafter panels 4 are attached to the modules 2 to form the inner walls of the rooms R. The panels 4 are attached to the side of each module 2 opposite to the corridor C. In the next step panels 6 to form the outer walls are attached to the free edge portions of the panels 4 forming the inner walls, opposite the modules 2. Façade cladding 7 is then attached to the outer panels 6 forming the outer walls (see FIGS. 15 and 37). As façade cladding 7 is provided on the outer panels 6, these panels 6 will in the following also be referred to as façade panels 6.

The step of attaching the slabs 8 and panels 4, 6 may be performed for different modules 2 in parallel. Hence, the first module may be connected to the panels and slabs at the same time as adjacent modules are arranged in a row, or array. As the modules being arranged adjacent to the first (or central) module are fixated at their respective position, further modules are arranged at these modules at the same time as panels and slabs are attached to the already provided modules. The first and second row may be constructed according to the manner described, i.e. a parallel extension of the rows or arrays.

Figure 10A:
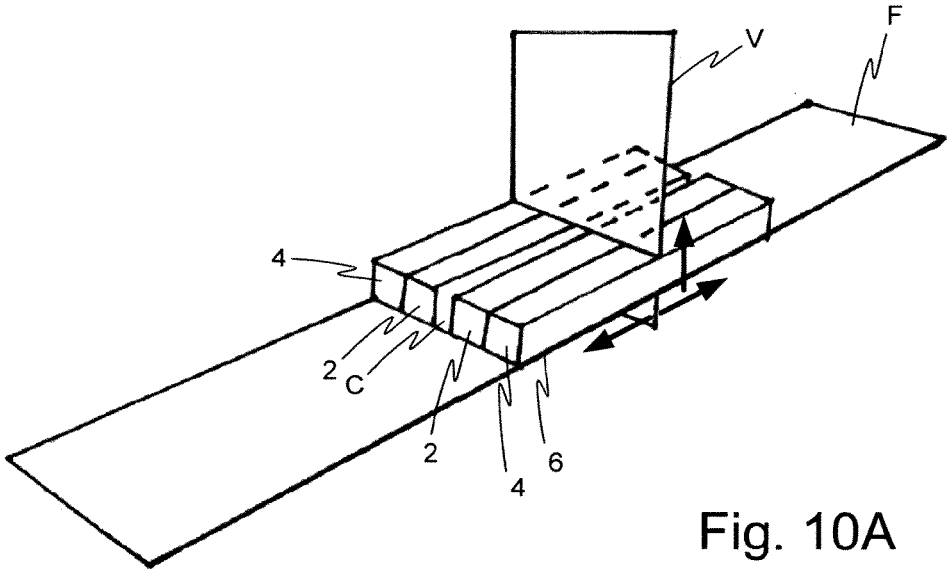
FIG. 10A-10B show how a building of the type shown in FIGS. 1-9 can be erected in two opposite directions.
Figure 10B:
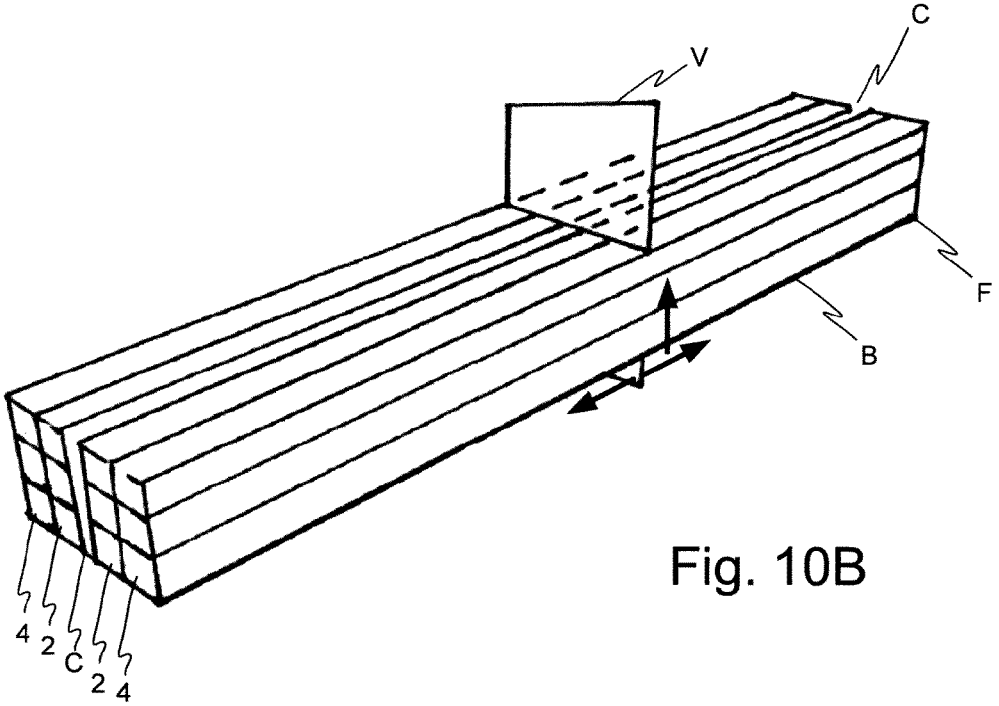

If the building B is to have further stories, the above steps are repeated, whereby the modules 2 of an upper storey are attached to the modules 2 of the storey below. As indicated in FIGS. 10A and 10B starting with one module 2, further modules 2 may be attached in any longitudinal direction of the building B and on top of the other modules 2. Since the building B is constructed in this manner, the work is very efficient. One team of construction workers can concentrate on aligning and stacking modules 2 using cranes (not shown), whereas another team of construction workers can concentrate on laying out slabs 8 and mounting panels 4, 6 to form the rooms R. The construction work moves from a starting point (vertical plane V in FIGS. 10A-10B) in two opposite horizontal directions, and at the same time in the vertical direction as is shown by arrows.

This on-site concept of erecting a building saves time and thereby reduces costs. Sometimes it may be preferred to gradually construct the building in only one direction, but also then the work is efficient since stacking of modules 2 can be performed upwards at the starting point meanwhile the panel-build rooms R are formed in sequence in horizontal direction.

Figure 11A:
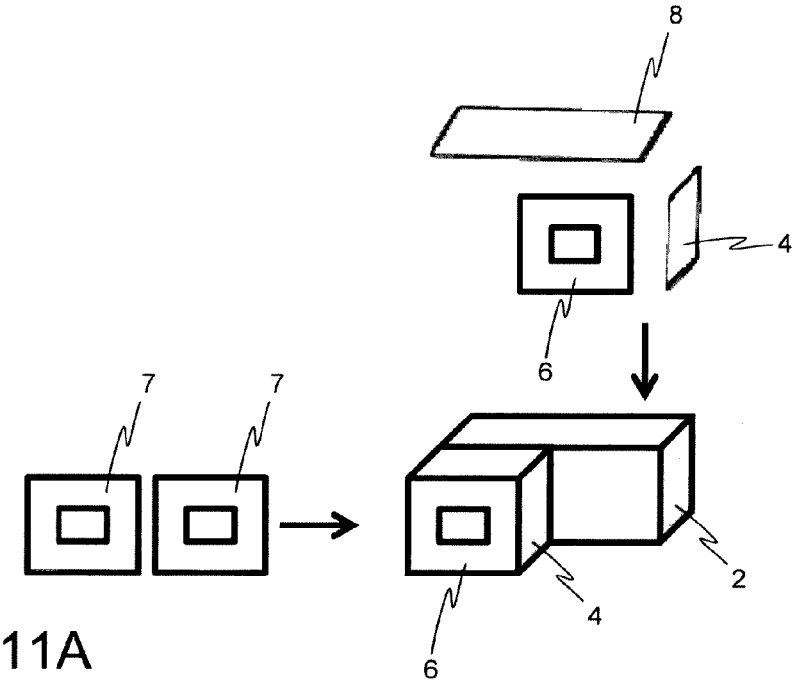
FIGS. 11A-11E show the construction method of a multi-floor building of the type shown in FIG. 10.
Figure 11B:
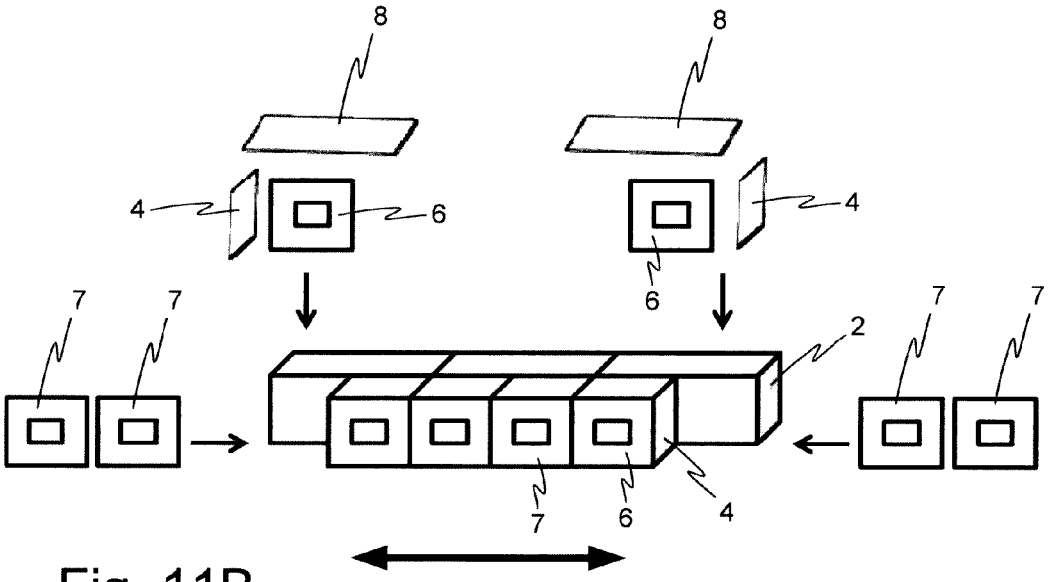
Figure 11C:
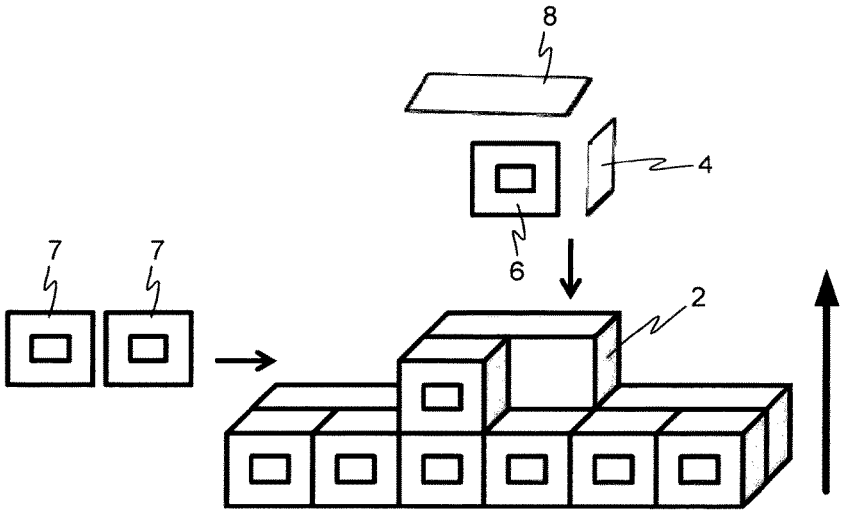
Figure 11D:
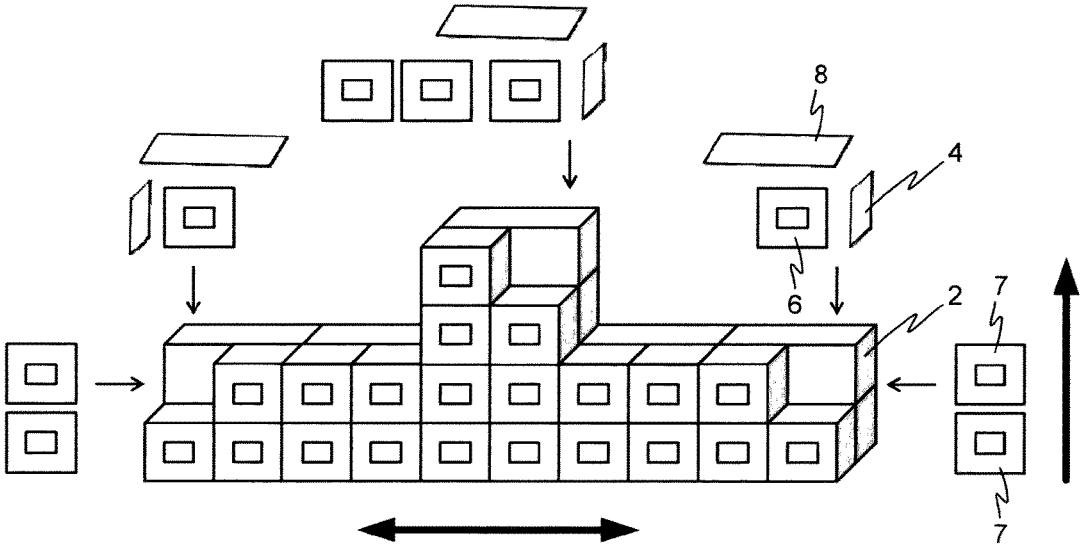
Figure 11E:
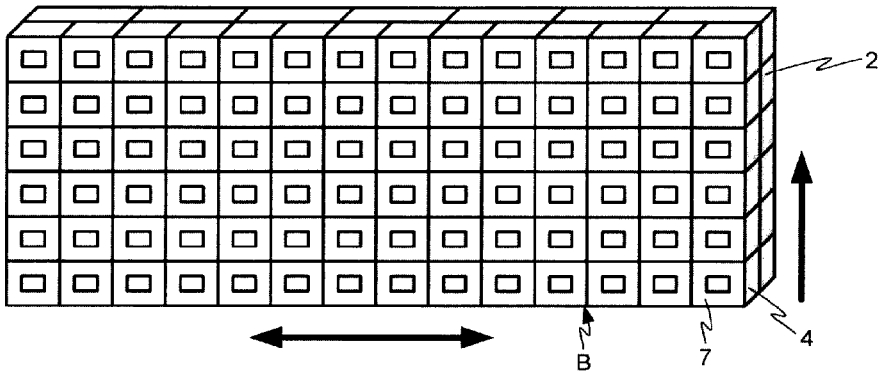

In FIGS. 11A-11E the formation of one side of a six-floor building is shown. Starting with FIG. 11A, a module 2 is secured to a foundation (not shown) and panels 4, 6 and slabs 8 are connected to the module 2 for creating a room. Additionally façade cladding 7 is provided. Continuing to FIG. 11B a horizontal array of modules 2 is formed and rooms are provided on the lateral side of each module 2. As is illustrated in FIG. 11B, the horizontal array is extending in both directions from the first module 2 such that construction workers may work at both ends of the array. In FIG. 11C a vertical extension of the array is shown, whereby a module 2 is arranged on top of the first module 2 on the ground floor. The vertical extension is preferably done when the ground floor is finished, although additional floors may be constructed simultaneously with the ground floor. The latter is shown in FIG. 11D, where construction work and assembly is performed on several floors simultaneously. The finished one-side building is shown in FIG. 11E.

Figure 12:
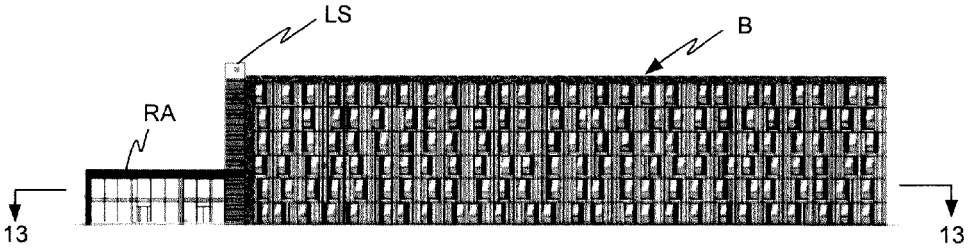
FIG. 12 is a side view of a multi-floor building of the type shown in FIG. 11.
Figure 13:
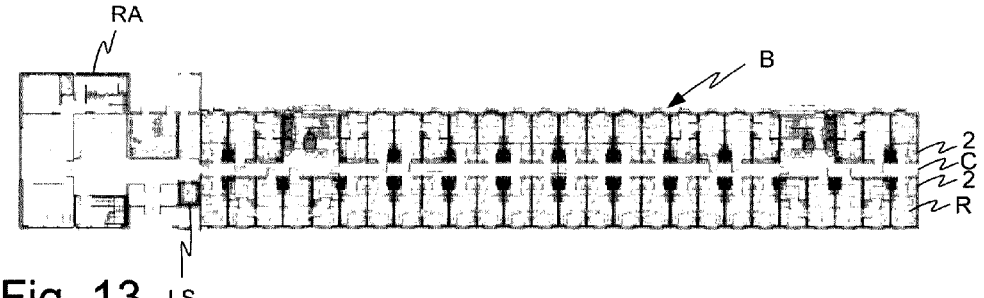
FIG. 13 is a section along section line 13-13 in FIG. 12.
Figure 14A:
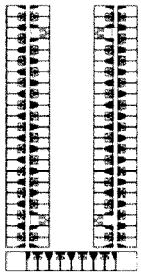
FIGS. 14A-14G are top views of alternative configurations of buildings constructed in accordance with the principles of the inventive concept.
Figure 14B:
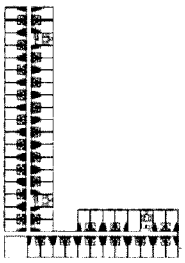
Figure 14C:
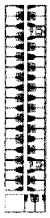
Figure 14D:
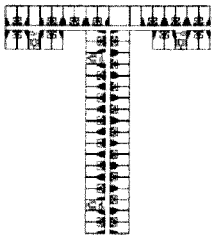
Figure 14E:
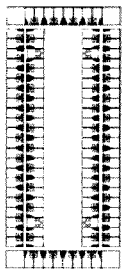
Figure 14F:
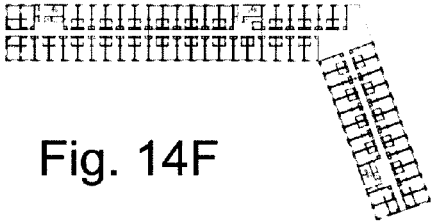
Figure 14G:
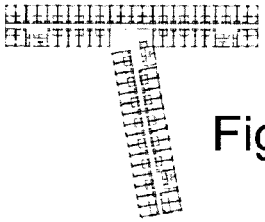

To finalize the building B further parts are added, such as a main entrance, elevators and staircases, but these parts are optional and will not be described in detail here. In FIGS. 12 and 13 there is shown an example of a six-floor building B built by means of the general inventive method. One end of the building B may have a reception area RA and an elevator or lift shaft LS. It is to be understood that these areas RA and LS may be of different kind depending on the type of building. In an alternative embodiment, the reception area RA and the lift shaft LS may be integrated in the building B. Further to this, the lateral sides of the building B may be covered by façade cladding elements commonly used for improving the quality and resistance of the building itself.

In FIGS. 14A-14G various ways of combining the standardized elements to form different types of buildings are indicated. All these variants are based on the same idea of aligning and stacking modules in the shape of so-called wet boxes 2 in two parallel arrays spaced by a corridor C. The panel-built rooms R are formed outside each array of wet boxes 2. It is understood that many other configurations are feasible than the ones shown in FIG. 14.

Figure 15:
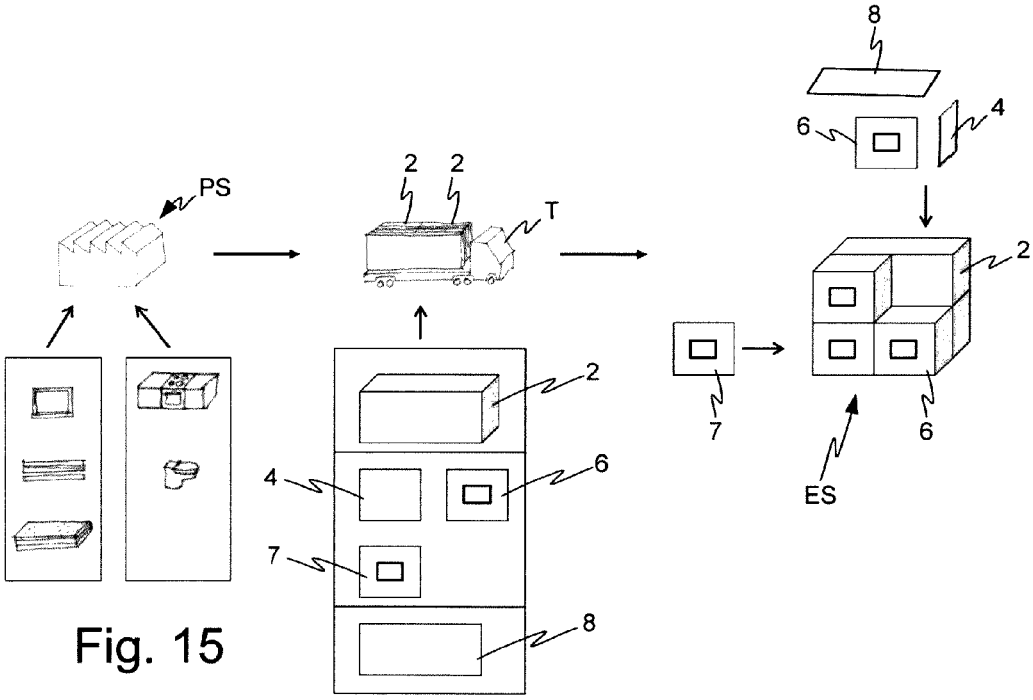
FIG. 15 shows how prefabricated elements are produced and transported to the site where the building is to be erected.

As shown in FIG. 15 and according to the concept the modules 2, the wall panels 4 and 6 as well as the facade cladding 7 and the slabs 8 are prefabricated in a specialized production site PS and then transported to the building or erection site ES. The sizes of the prefabricated elements are such that they may be transported on standard trucks T.

Preferably, the external dimensions of the modules 2 are adapted to standard sizes of trucks. For instance, a module 2 of the type shown in FIG. 16 may have a length of 6.5-7.0 m, a depth of 2.5 m and a height of 3.0 m. Then two modules 2 can be carried on a standard truck T. Module size can of course be modified in order to adopt to truck sizes of different kind in various states. In similar way, the dimensions of the panels 4, 6, 7 and the slabs 8 are adapted to match the size of a standard truck T. This means that the production, transportation and distribution can be optimized so that costs are kept low. Due to the standardization, planning of a construction project is facilitated and furthermore it is easy to calculate construction costs for various projects. It should be mentioned, that dimensions and sizes of the prefabricated elements may vary depending on national standards and requirements specific from state to state. However, the inventive concept is flexible in this regard and easy to adapt to specific criteria.

Figure 16:
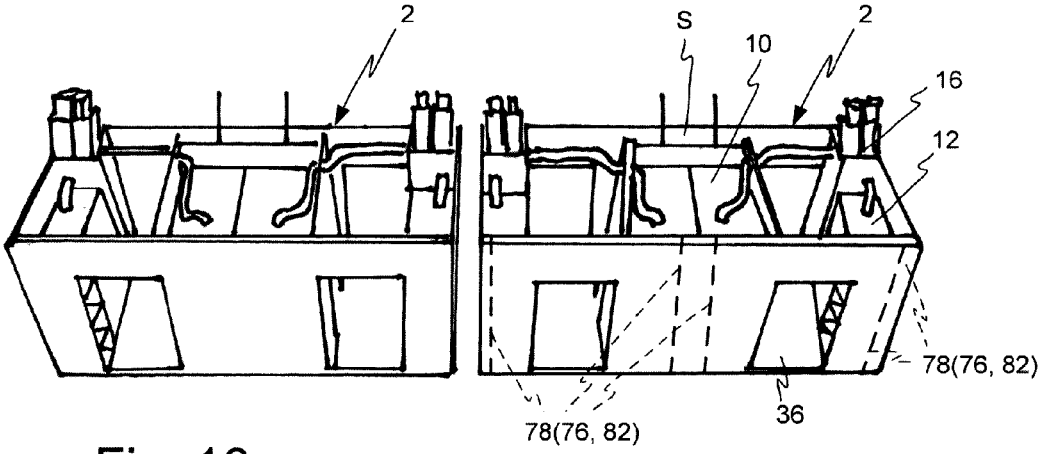
FIG. 16 shows two modules of the system obliquely from above.

In FIG. 16 two modules 2 are illustrated, each of which defining a rectangular cuboid shape. The modules 2 may have slightly different fittings depending on the intended use, but a kind of bathroom 10 is present in all modules 2. If the modules 2 for instance are intended for use in nursing homes, the bathroom may have other types of fittings than a regular bathroom 10. In some modules 2 there is a kitchen part 12 and in other modules 2 the kitchen part 12 may be replaced for instance by wardrobes and/or coat hangers 214 (see FIG. 43B). A common feature of the modules 2 is that they have a ready-to-use wet area with waterproof layers on the interior walls and floor and optionally on the ceiling.

Figure 17:
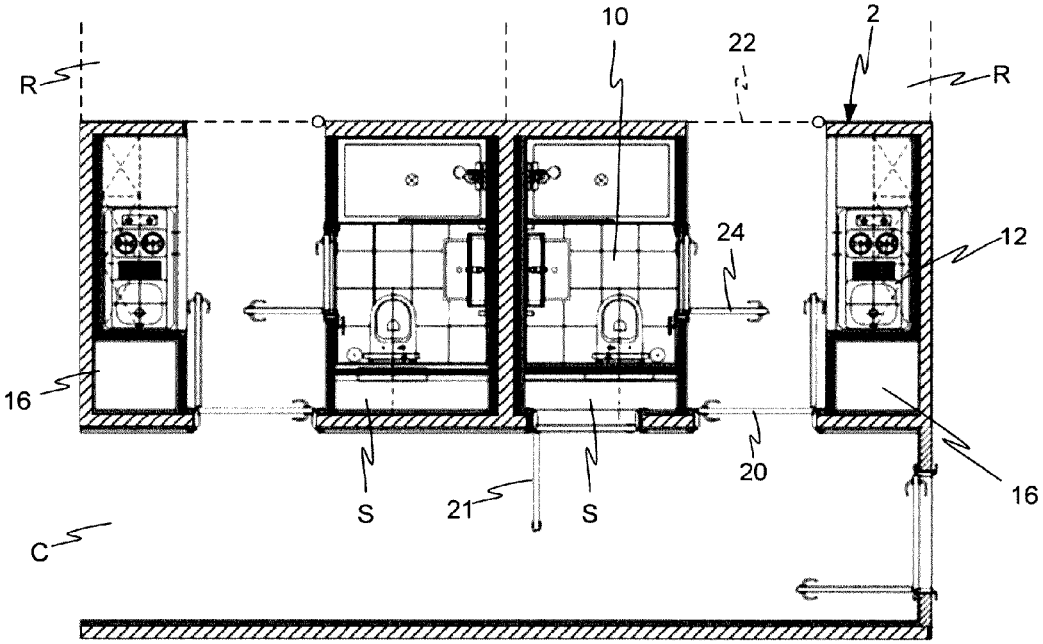
FIG. 17 shows on a larger scale a horizontal section of a module of FIG. 16 in connection with a corridor.

In each module 2 there is at least one vertical through ventilation duct 16, (see FIG. 17). At the top of each module 2, there is a space 18 for different kinds of pipes, cables etc (see FIG. 18). Each module 2 has at least one door 20 that opens towards the corridor C. Preferably, there is also a so-called shaft or service door 21 which opens towards the corridor C in order to provide access to supply units (water, electricity, etc) in a space S (see FIG. 17). Optionally, there may also be a door 22 that opens towards the room R on the opposite side of the module 2 with respect to the corridor C.

The modules 2 may be completed in the factory with all fittings required for the intended use of the module 2 in the finalized building B. The term fittings also include complete finishing, fixtures, set-ups, etc. Thus, a complete bathroom 10, including a bathroom door 24, an optional complete kitchen part 12, possible complete wardrobes 214 and all additional doors 20, 21, 22 are installed in the modules 2 already in the production site PS. All cables are pre-installed, such as main electrical and low voltages supplies, switch board meters, internet connections, etc. Furthermore, all types of water conduits—such as tubings for heated and tap water as well as cooling and sprinkler systems—are installed in the factory of the production site PS. The same goes for all ventilation ducts and the sewage conduit system. These assemblies are also installed in the modules 2 at the production site PS. In summary, all so-called shaft assemblies and technical installations are pre-installed in the module 2.

Due to the standardization and pre-installation of fittings and supplies, the modules 2 are basically ready-to-use when arriving by truck at the erection site ES. Furthermore, the well-planned arrangement of cables and conduits makes it easy to connect all supplies when the modules 2 are aligned and stacked on the erection site ES. Erection of the building B can be performed by staff mainly trained in construction work, whereas the requirement of highly skilled staff such as electricians and plumbers can be kept on a very low level which reduces construction time significantly.

Figure 18:
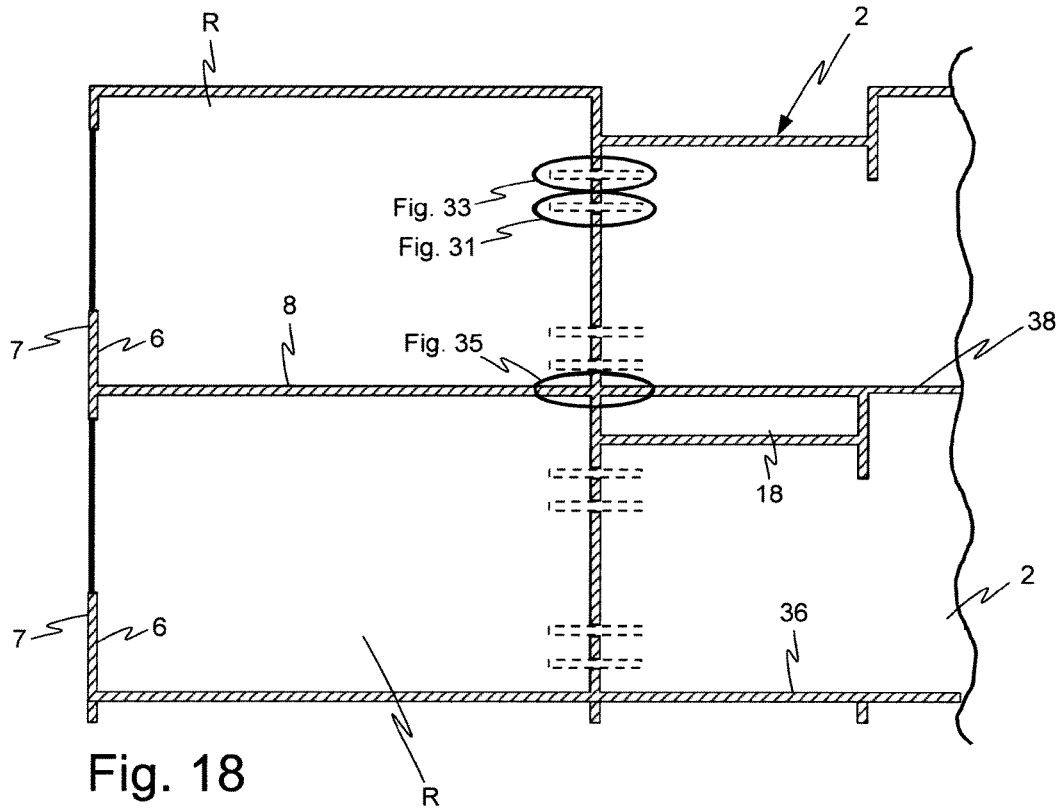
FIG. 18 shows a partial vertical section of the left side of the building illustrated in FIG. 8.

The vertical section of FIG. 18 shows how two stacked modules 2 may be connected to panel-built rooms R, each of which defining a further rectangular cuboid shape in addition to the cuboid shapes defined by the modules 2 The connections shown schematically in FIG. 18 will be described later.

Figure 19:
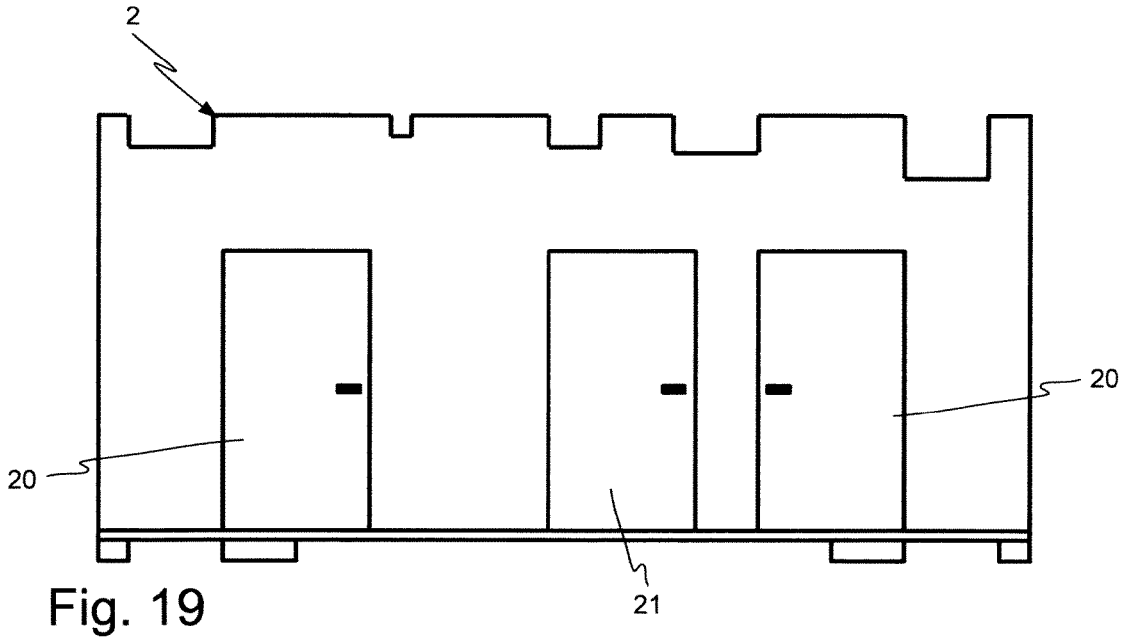
FIG. 19 shows a module of FIG. 16 from a front side.

FIG. 19 is a front view of a module 2 illustrating two corridor doors 20 and a service door 21 between the two compartments of the module 2.

Figure 20:
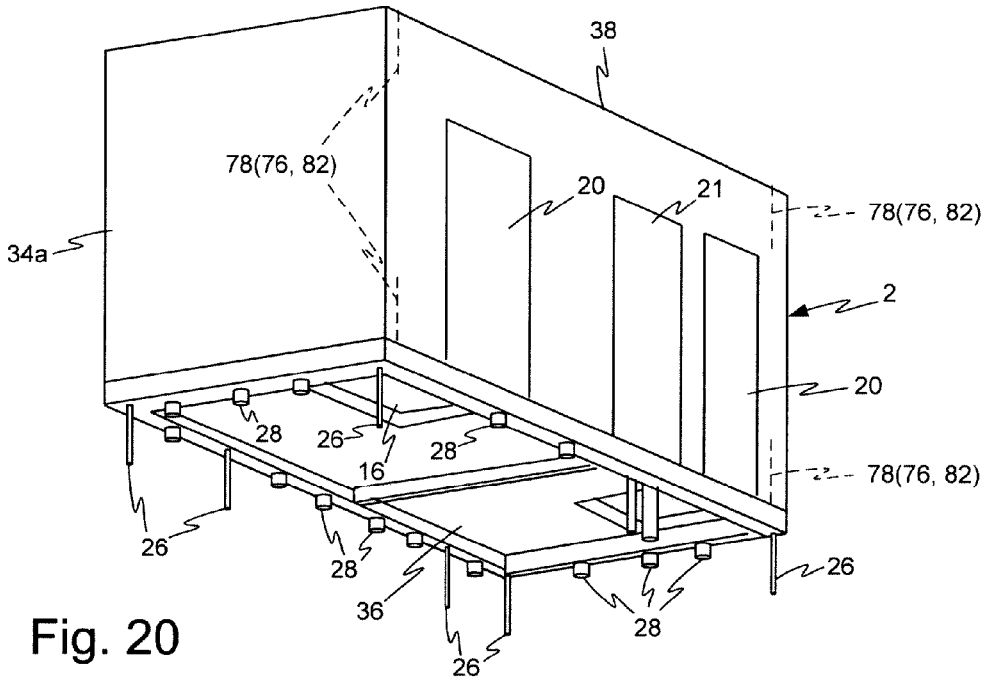
FIG. 20 shows obliquely from below an upper module to be mounted to a lower module.

As best shown in FIG. 20, each module 2 has a number of relatively long rods 26 and a number of short rods 28 directed downwards from a lower side of the module 2. In the shown embodiment, the downwardly projecting rods 26 and 28 have circular cross section and the diameter of the short rods 28 is larger than the diameter of the long rods 26. Each corner of the lower side of the module 2 has a long rod 26, and both long and short rods 26, 28 are placed at the outer edges of the lower side of the module 2.

Figure 21:
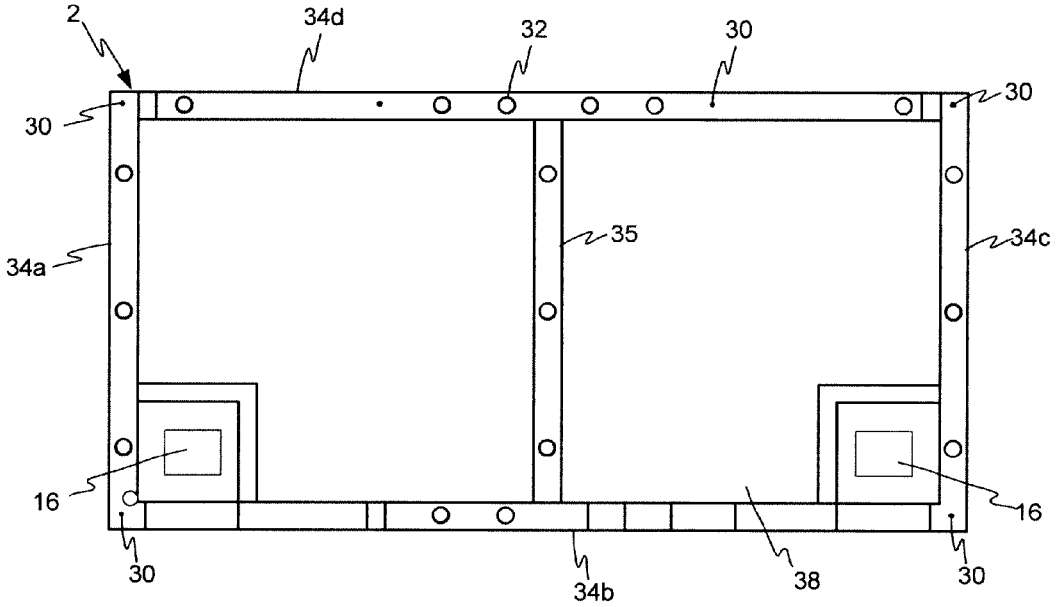
FIG. 21 shows from above the lower module on which the module of FIG. 20 is to be placed.

As seen in FIG. 21, the module 2 has top openings 30, 32 which match and are configured to receive the long and short rods 26, 28 of a module 2 which is stacked on top of the lower module 2. When the upper module 2 is lowered, the short rods 28 are inserted in the openings 32 of the lower module 2 adapted to receive the short rods 28.

Figure 22:
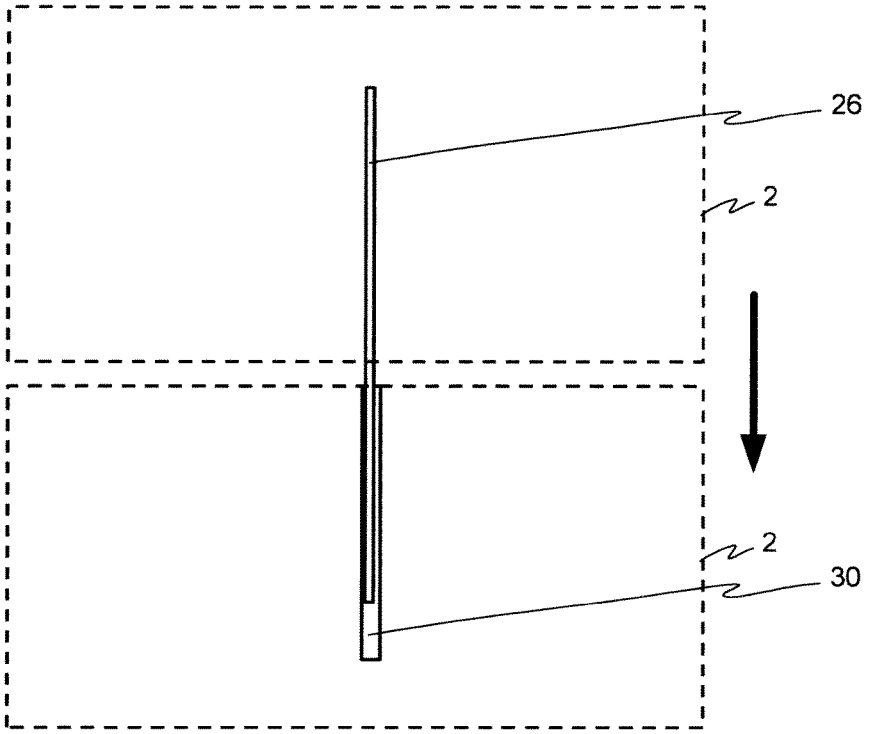
FIG. 22 shows on a larger scale anchoring means and guiding means used when stacking modules on each other vertically.
Figure 23:
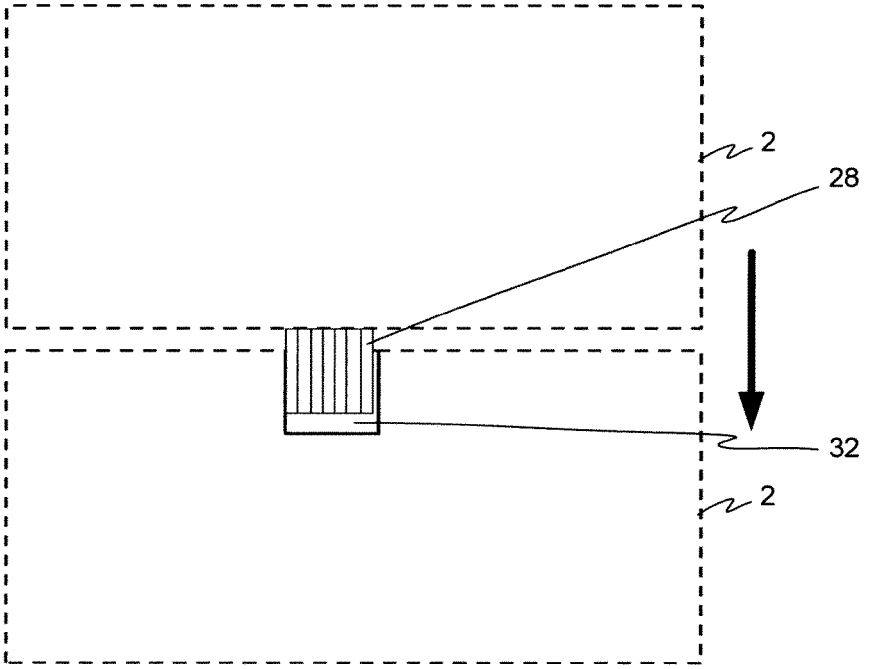
FIG. 23 shows on a larger scale guiding means and anchoring means used when stacking modules on each other vertically.
Figure 24:
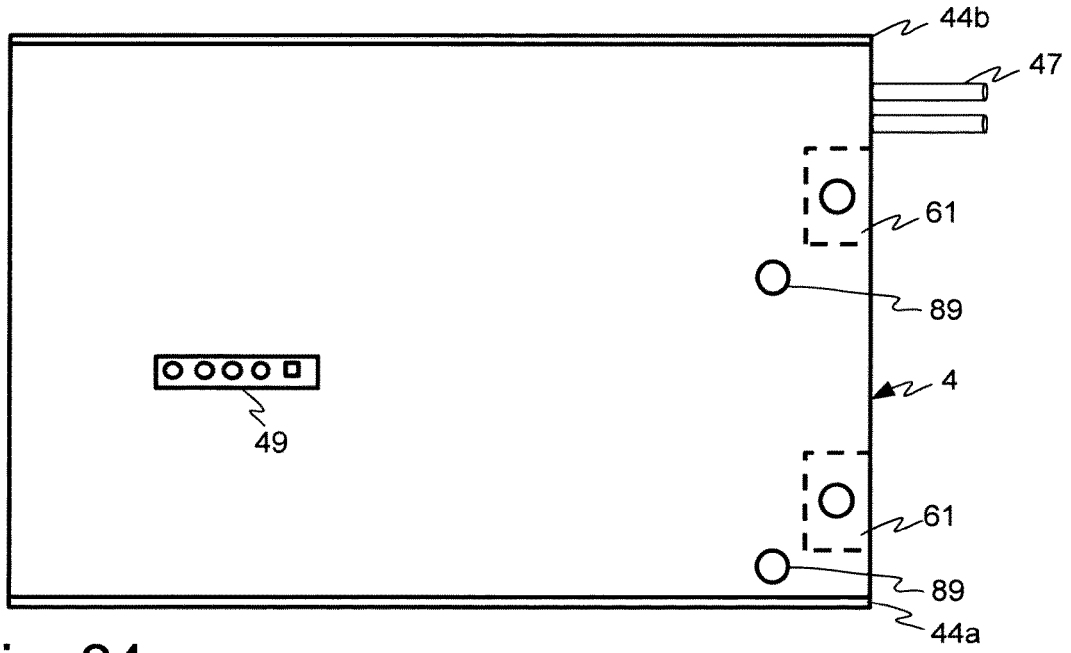
FIG. 24 shows a prefabricated wall panel from a front side.
Figure 25:
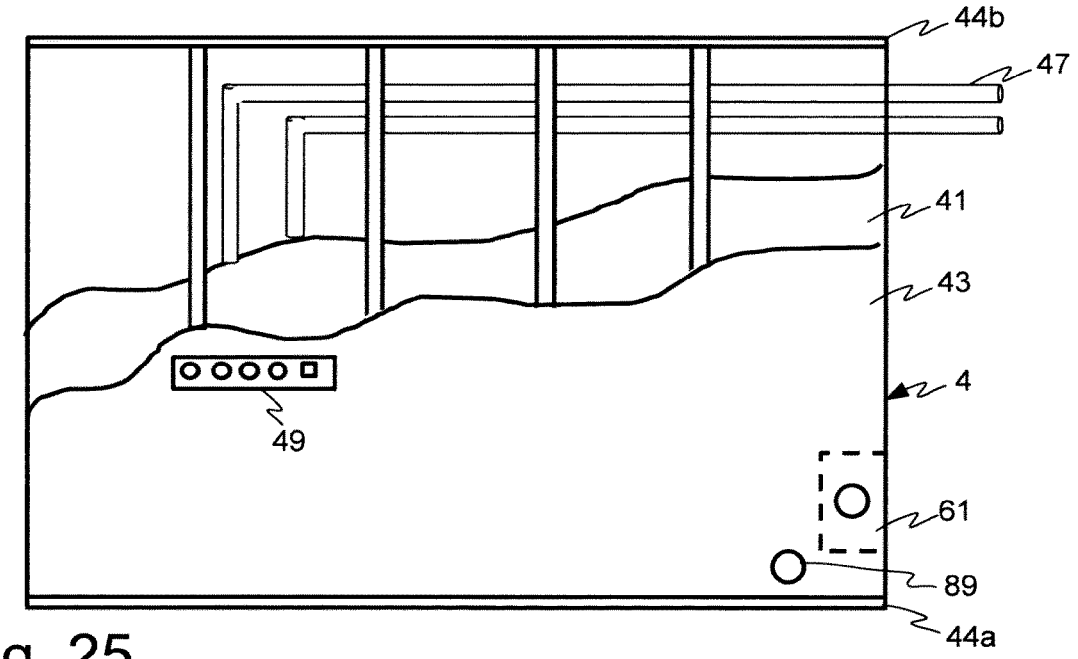
FIG. 25 shows the wall panel of FIG. 24 with certain portions cut away.

Hence, when stacking modules 2 on top of each other the rods 26, 28 are inserted in the matching openings 30, 32 respectively, as is shown in detail in FIGS. 22-23. This means that the rods 26, 28 serve as guiding and alignment means which facilitate the stacking procedure which is performed by means of cranes (not shown). When the stacking of two modules 2 on top of each other is completed, the rods 26, 28 serve as anchoring means which secure the modules 2 to each other in all directions. Hereby, the stack of aligned modules is stable when the on site construction operations continue with forming the panel-built rooms R on either side of the corridor C. The rods 26 and 28 also contribute to the overall stability of the complete building B with respect to forces which may occur, such as wind, minor quakes, etc.

FIGS. 20-21 illustrate that each module 2 has generally four outer walls 34*a*-34*d*, a floor slab 36 and a roof slab 38. It is also shown that the module 2 may have at least one inner partition wall 35. The technical installations of the module 2 as well as its equipment will be further described in the following.

As illustrated in FIGS. 24-25, 26A and 26B, each panel 4 for forming the room walls normally has a wooden bearing wall or core 41, gypsum boards 43, gypsum board frames, fire and sound insulation 45 and optionally heat insulation (not shown), pre-installed electrical and low voltage cabling 47 and pre-installed sockets and switches 49. The panels 4 are prefabricated in the factory as indicated above. At the upper and lower edges of each panel 4 a wooden batten 44*a* and 44*b* is arranged, fastened to the wooden bearing wall of the panel 4. Each batten 44*a*, 44*b* projects outside the panel 4 on opposite sides of the panel 4. Thus, in cross-section the form of the panel 4 will have an I shape (see FIG. 26B).

Figure 26A:
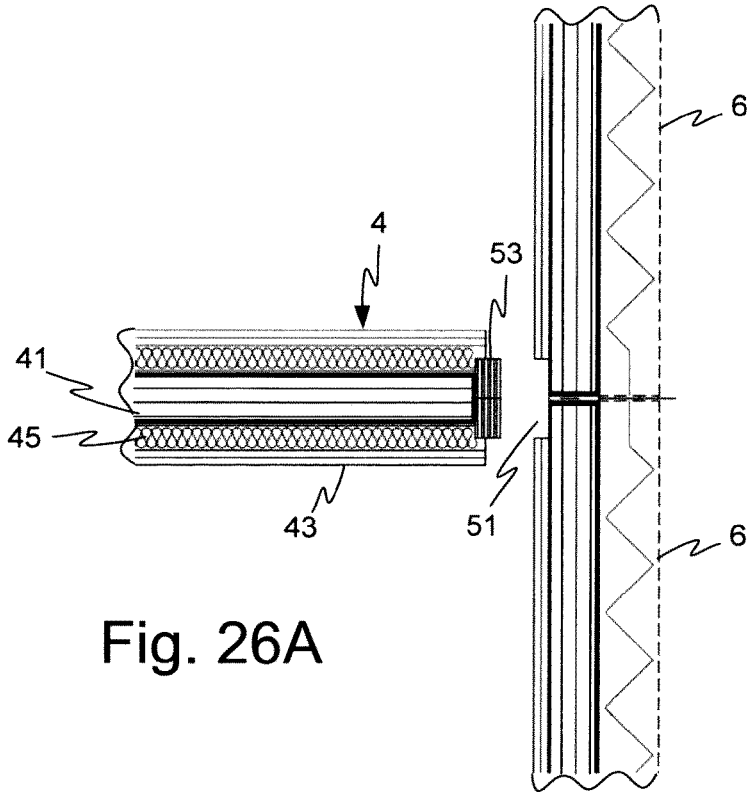
FIG. 26A shows in a horizontal section how a panel of FIGS. 24-25 is joined to facade panels (cf.

FIG. 26A shows in a vertical section that the free front edge portion of the wall panel 4 has a lateral projection 53 matching a recess 51 of façade panels 6 for facilitating the joining and forming a close fit joint.

Figure 26B:
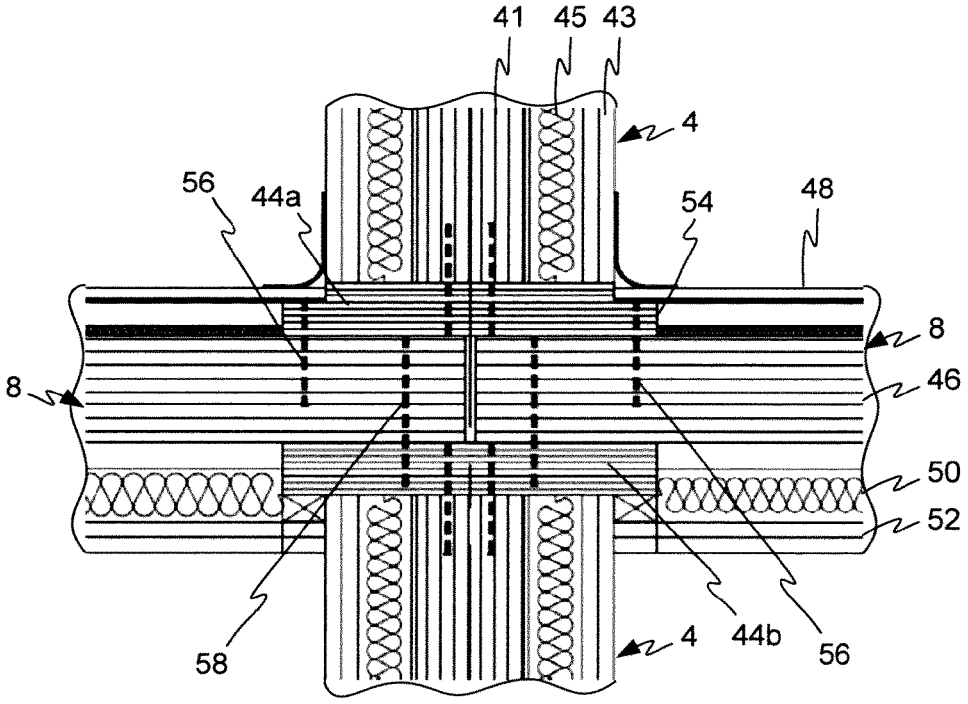
FIG. 26B shows in a vertical section how wall panels of FIGS. 24-25 are joined to slabs (cf.

FIG. 26B illustrates two slabs 8 forming floors. Each prefabricated slab 8 has a wooden core element 46 on top of which a dry layer 48 is placed. The slab 8 normally also has an insulating layer 50 and a lower layer 52. The upper layers end shortly before the edge of the wooden core element 46, whereby a recess 54 is formed at the joint between two slabs 8 in assembly of the floor. In the recess 54 between the slabs 8, the batten 44*a* of a panel 4 is to be received. Each panel 4 is fixed to a slab 8 by means of fastening screws 56, 58 going through the battens 44*a*, 44*b* of the panel 4 and into the wooden core element 46 of the slab 8.

Figure 27:
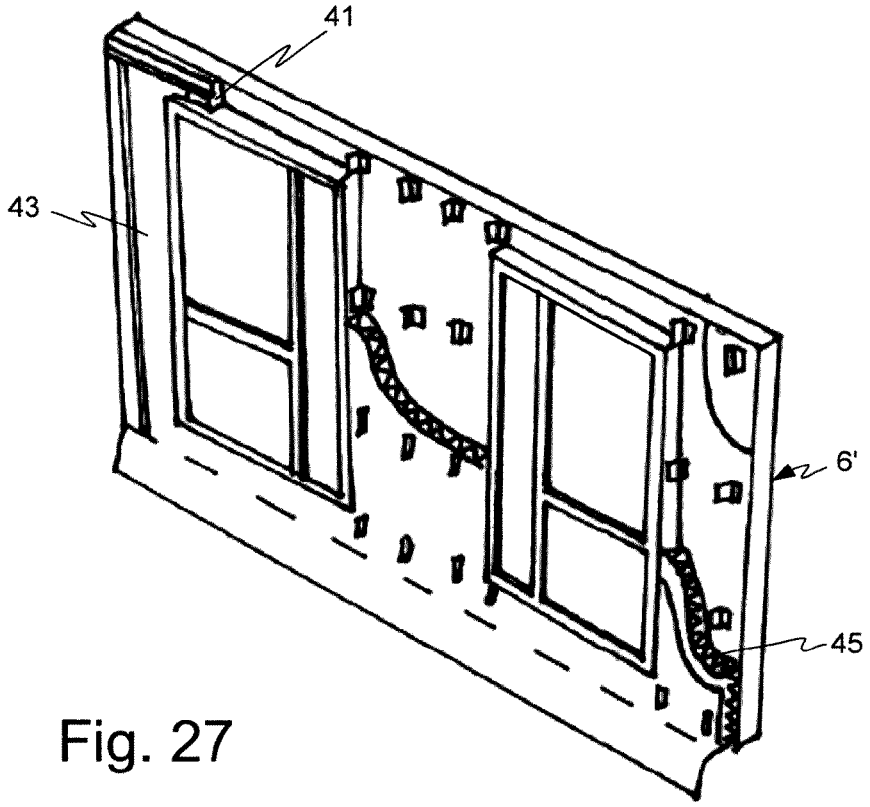
FIG. 27 shows a prefabricated facade panel with two windows.

A facade panel 6' with two windows is shown in FIG. 27. The facade panel 6' is preferably of similar structure as the wall panels 4. Hence, it has a wooden core 41, a gypsum board 43 and insulation 45. The facade panels 6' are fastened to the upright free edge portions of the wall panels 4, for instance by relatively long screws (not shown) or other fastening means which are driven into the panel wall edge portions from the outside of the façade panel.

This type of facade panel 6' may have the length of two rooms which then will include two windows, one for each room. Normally, a large facade panel 6' of this type is not provided with any electrical and low voltage cabling or installed sockets and switches but may in another embodiment be. The panel 6' may be fixed to the panels 4 and to the slab 8 according to the above mentioned fixing procedure.

Preferably, the wooden cores 41 and 46 described above are made of cross-laminated timber (CLT), but other wooden structures are of course feasible. However, CLT cores have proven very good results for prefabricated panels and slabs of this kind. The strength is excellent and it is easy to handle. In particular embodiments, the module 2 is constructed as a load-bearing structure carrying the weight of the building. Further, the walls and panels may also be constructed as load-bearing structures thus reducing the need for further structural components necessary for securing the robustness of the building.

Figure 28:
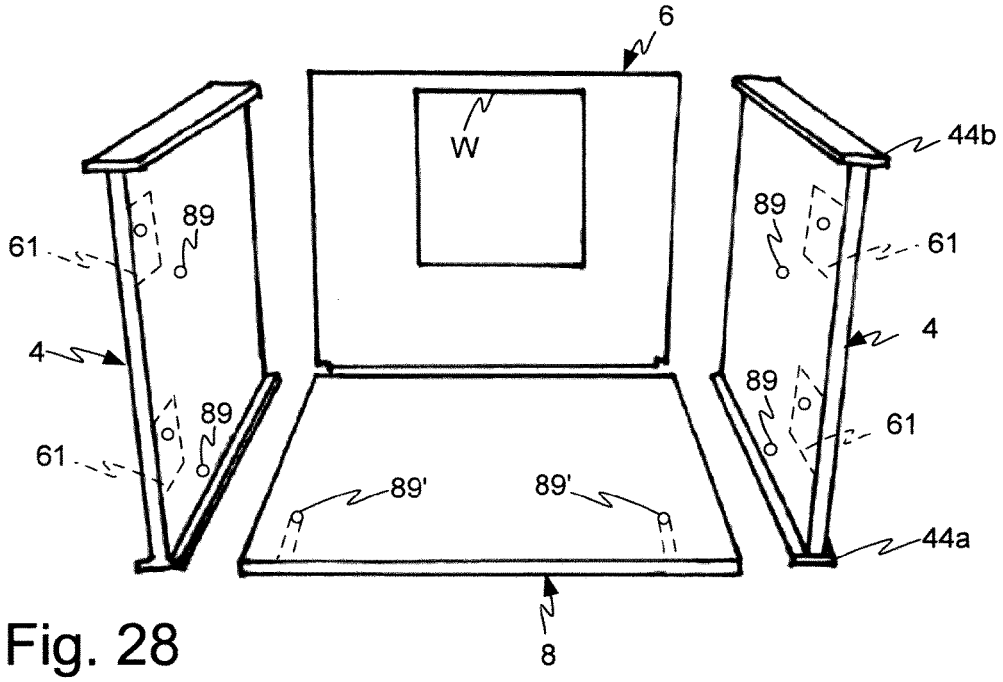
FIG. 28 shows three panels and a slab used for forming a room.

FIG. 28 shows a standard one-window facade panel 6 in its position between two inner panels 4. The panel 6 has a preinstalled window W (shown schematically in FIG. 28) which may be replaced by a balcony door depending on whether the building will be constructed with balconies or not (cf. FIG. 44). Façade cladding 7 are attached to the outside of the facade panels 6 by the arrangement shown in FIG. 37. Basically, the façade cladding 7 is hung on the facade panels 6. The façade cladding 7 may be of any colour and material depending on the kind of building and the budget of the construction project. The façade formed by the façade cladding 7 is easily mounted to the outside of the panel 6 on the building site or on the production site without any need for specially trained staff In FIGS. 29-32 there is shown a static connecting device 60, 70 with three main parts: a first connector member 60, a second connector member 70 and an anchoring element in the shape of a rod 65.

Figure 32:
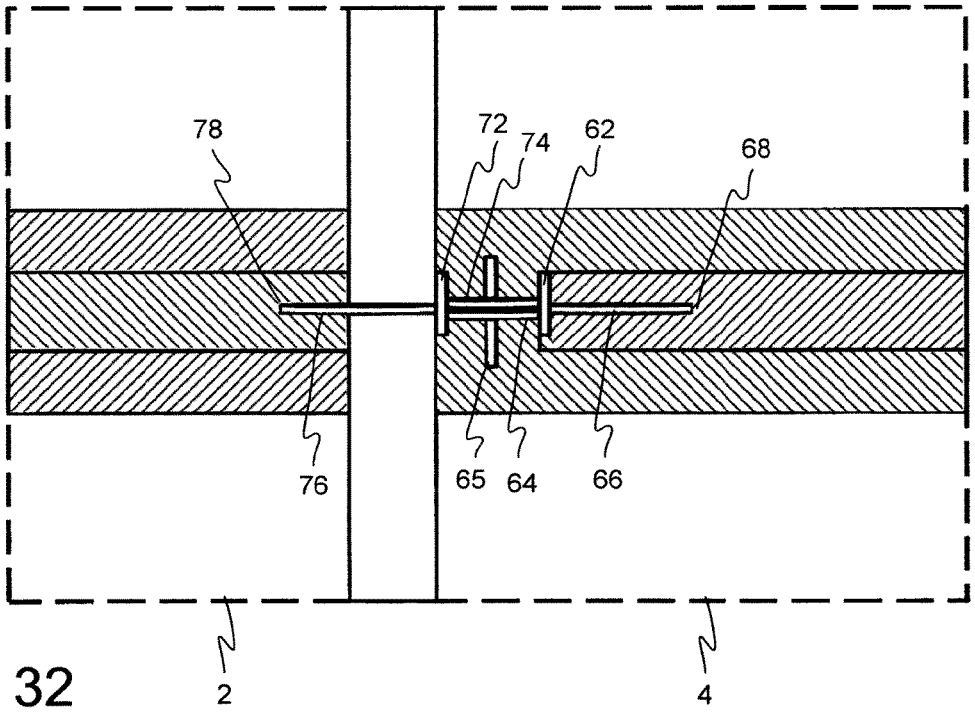
FIG. 32 shows a horizontal section of the static connector shown in FIGS. 29-31 (section line 32-32 in FIG. 31; cf. also FIG. 5).
Figure 33:
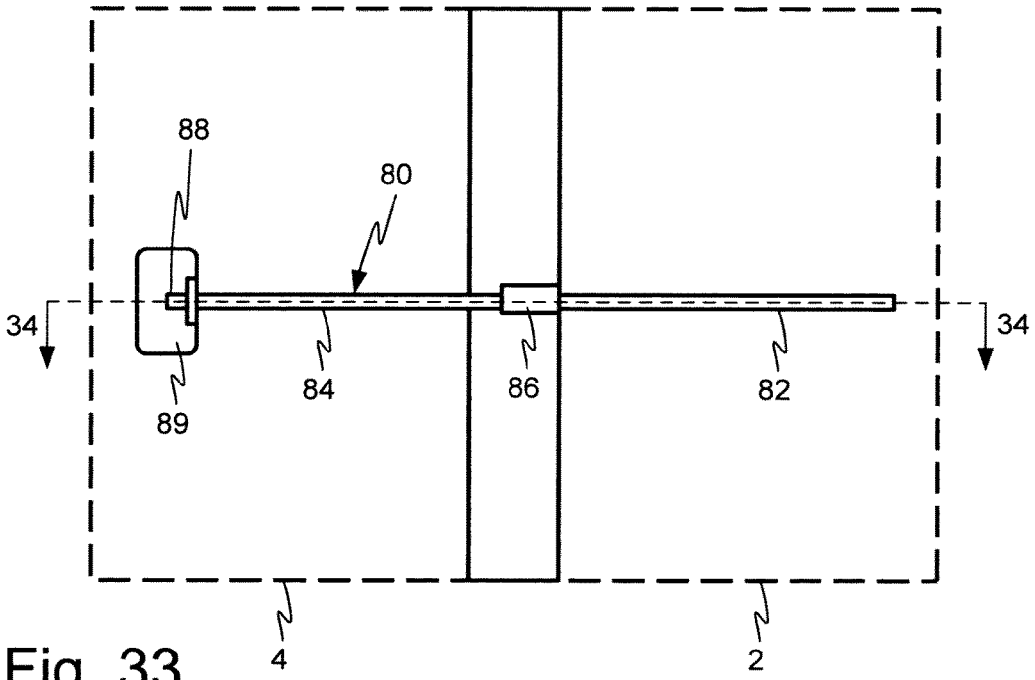
FIG. 33 shows a vertical section of a first dynamic connecting device for connecting a panel to a module (cf.
Figure 34:
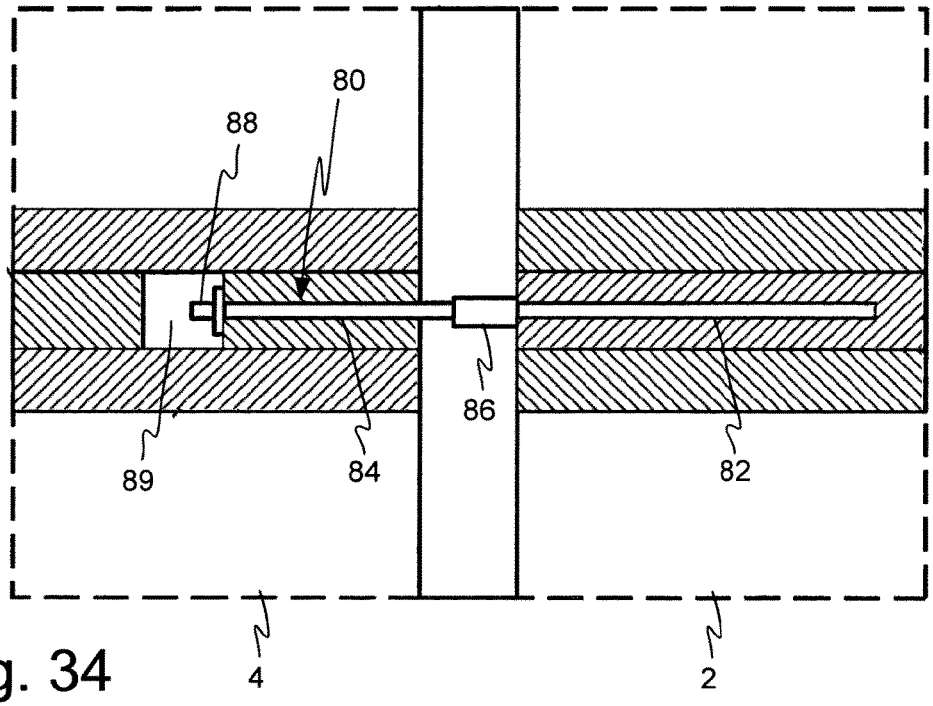
FIG. 34 shows a horizontal section of the first dynamic connector of FIG. 33 (section line 34-34 in FIG. 33).

The first connector member 60 comprises a base plate 62 and a flange 64 projecting therefrom (FIG. 32). The base plate 62 is normally connected to the wall panel 4 by means of at least one pin 66 inserted with a close fit in a matching bore 68 in the wall panel 4, or by screws or similar fasteners (not shown). The flange 64 is arranged in a cut-away 61 in the panel 4, and it has an opening 63 for receiving the rod 65.

The second connector member 70 comprises a base plate 72 and a flange 74 projecting therefrom (FIG. 32). The base plate 72 is connected to the module 2 by means of at least one pin 76 inserted in a matching bore 78 in the module 2. The flange 74 of the second connector member 70 projects from the module 2, and it has an opening 73 for receiving the rod 65.

The bores 68, 78 of the respective connecting devices 60, 70 as well as the recess or cut-away 61 may form engagement means integrated in the wall panel 4 or module 2, respectively. The engagement means contribute to the attachment and use of the static connecting device 60, 70.

Figure 29:
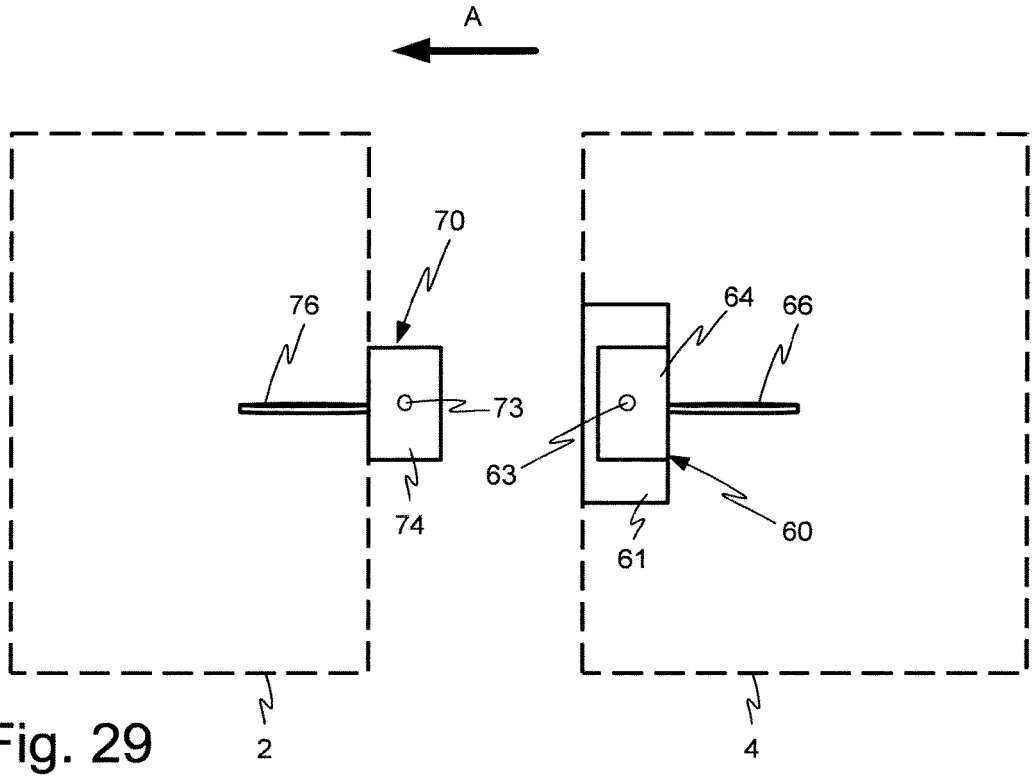
FIG. 29 shows in a partial vertical section a static connecting device before connecting a wall panel to a module.
Figure 30:
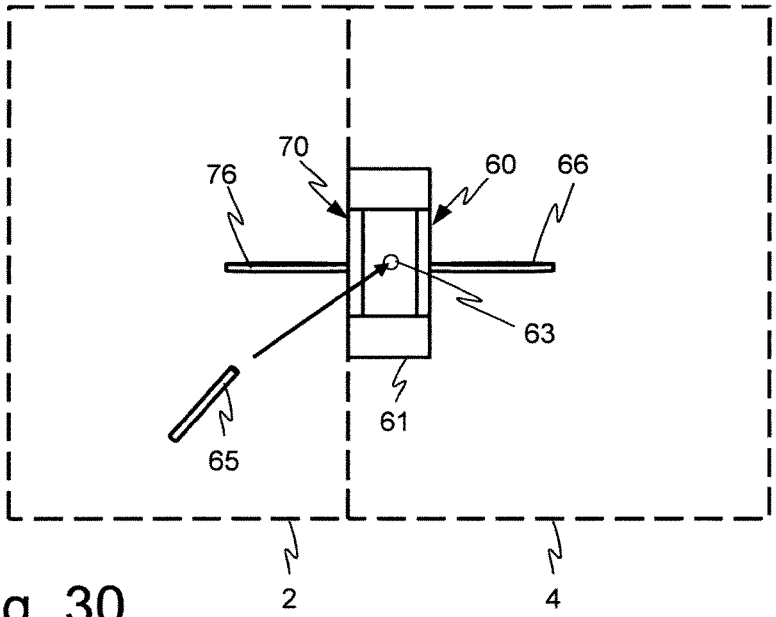
FIG. 30 shows the static connector of FIG. 29 being assembled.
Figure 31:
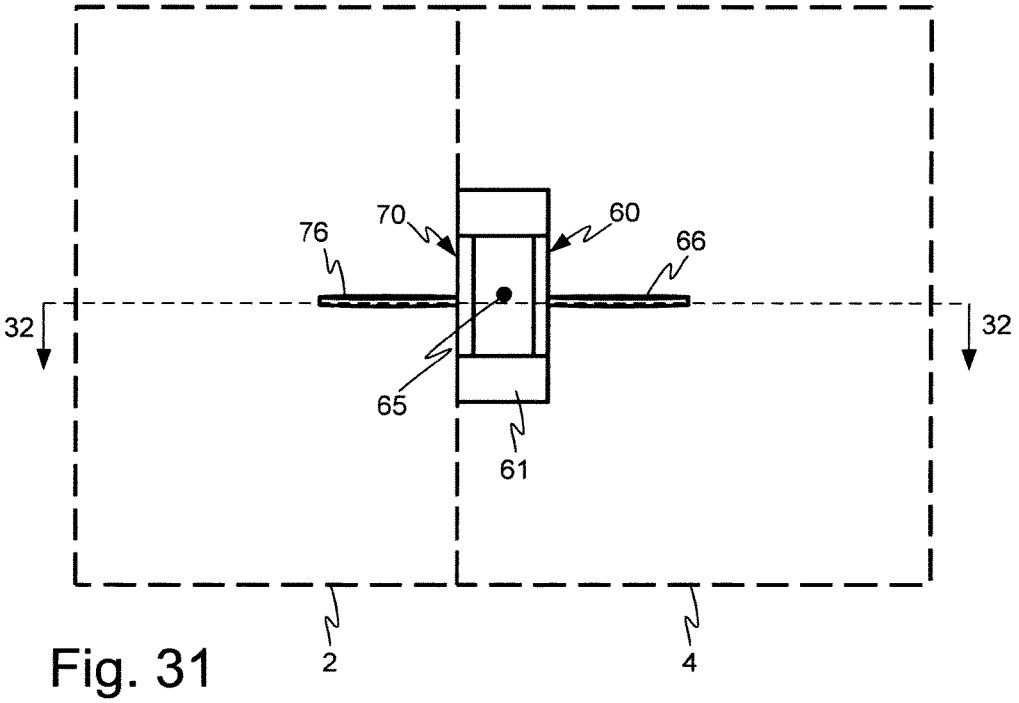
FIG. 31 shows the static connector of FIGS. 29-30 in its assembled position (cf.

When mounting the wall panel 4 to the module 2, the panel 4 is moved towards the module 2, which is installed on ground or on a foundation F or stacked on another module, in the direction of arrow A in FIG. 29 until the flange 74 of the second connector member 70 is received in the cut-away 61 of the panel 4 (FIG. 30). In this position, the rod 65 is pushed through the aligned openings 63 and 73 of the two flanges 64 and 74 and the static connection is established; shown in FIG. 31. In the horizontal section of FIG. 32, the static connecting device 60, 70 is shown in detail.

The underlying idea with the static connectors 60, 70 is that they should fit integrated engagement means (cut-aways, anchoring means, etc) of the elements to be connected.

In addition to the static connecting devices 60, 70 other types of connectors may be used, namely so called dynamic connectors. This type of dynamic connecting device 80 is provided for decreasing or eliminating the small gaps between building elements that may be left after connecting the static connectors 60, 70. FIGS. 33-36 show such dynamic connectors 80, 80' which are used when mounting panels 4 to module 2 and slabs 8 to module 2. The dynamic connector 80 may also be used when mounting the two different panels 4, 6 together. The type of dynamic connector 80 shown in FIGS. 33-34 consists of two bars 82, 84 which have external threads and which are joined by a sleeve 86 having internal threads. In use, the first bar 82 is inserted in a bore of the wall of the module 2 and fastened, for instance by glueing. The sleeve 86 is "hidden" inside the wall of the module 2. The panel 4 is moved into abutment with the wall of the module 2 and the free end of the second bar 84 is threaded into the sleeve 86. In order to complete the dynamic connection, counter means are used in the shape of a nut-washer assembly 88 received in a cut-away 89 of the panel 4.

The bore of the module wall, as well as the recess or cut-away 89, may form engagement means integrated in the wall of the module 2 and the panel, respectively. The engagement means contribute to the attachment and use of the dynamic connecting device 80. Tightening of the connector 80 is accomplished by a standard wrench (not shown) engaging the nut of the nut-washer assembly 88.

Figure 35:
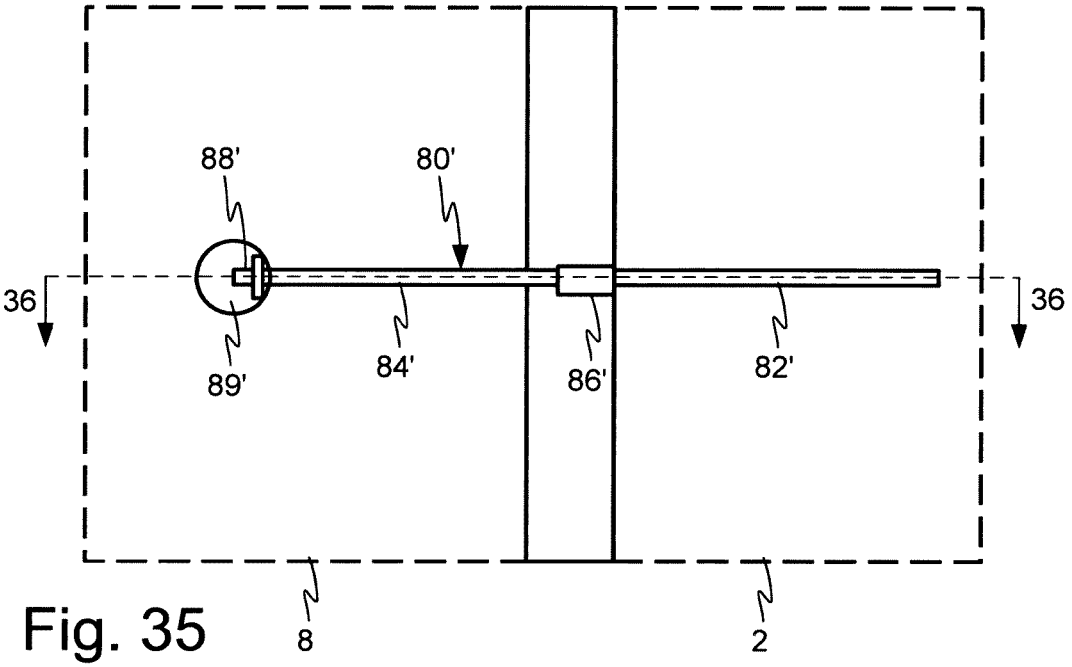
FIG. 35 shows a horizontal section of a second type of dynamic connector for connecting a slab to a module (cf.
Figure 36:
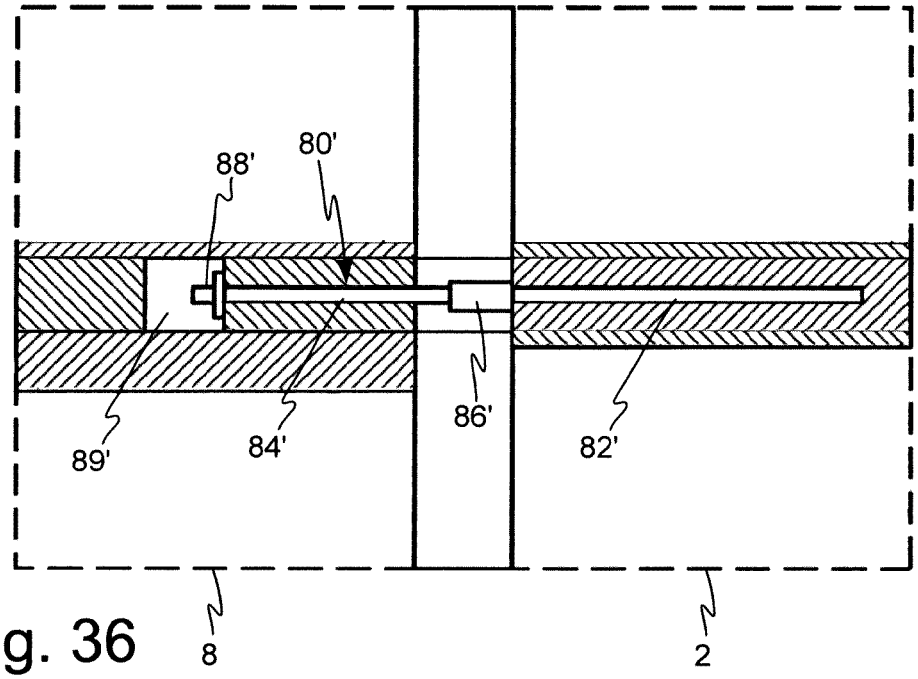
FIG. 36 shows a vertical section of the second dynamic connector of FIG. 35 in a joint between a slab and a module (section line 36-36 in FIG. 35).

A similar type of dynamic connector 80' can be used for module-slab connection as is shown in FIGS. 35-36. The structure of this connector 80' is basically the same as the connector 80 described above, but the cut-away 89' is of a slightly different shape. The bore which receives the bar 82' in the module wall and the recess or cut-way 89' may be regarded as integrated engagement means of the type described above. Tightening is accomplished in same way as described above.

The idea behind the dynamic connecting operation is that the elements to be connected shall have prefabricated means so that the tightening can be performed swiftly on the erection site. The recessed cut-aways 89, 89' and the pre-installed fastening bars 82, 82' and connecting sleeves 86, 86' make it possible to achieve quick tightening by use of tools which are easy to handle.

In a preferred embodiment, a single connector may be utilized which acts as both a static and a dynamic connector. Hence, the connectors 60, 80 or 70, 80 may be replaced by a single connector forming a combined connecting unit Preferably, sealing strips with rubber strings (not shown) are inserted in the joints between wooden elements of the building.

Figure 37:
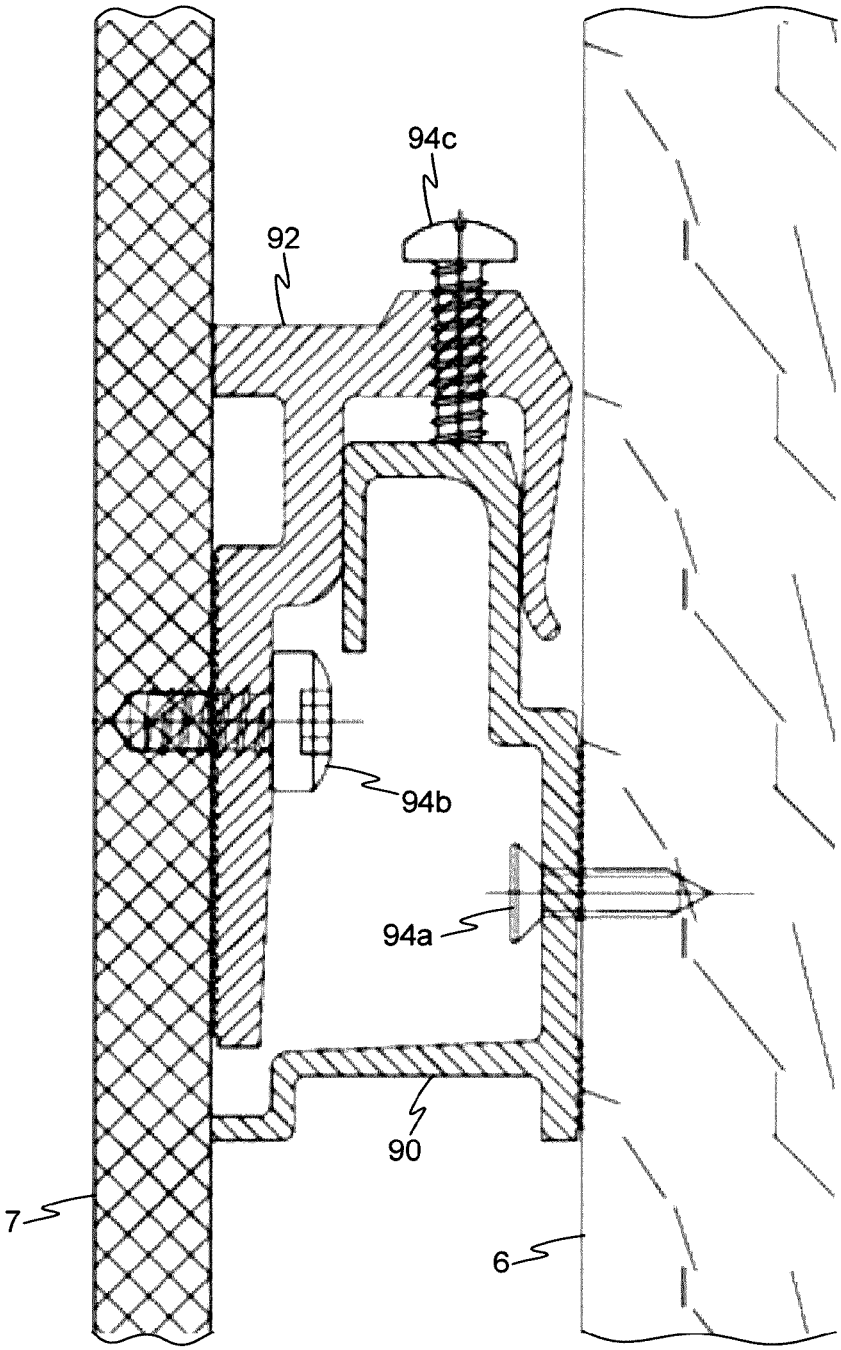
FIG. 37 shows a vertical section illustrating an example how façade cladding is attached to a facade panel.

FIG. 37 shows an example device for attaching a façade cladding 7 to a facade panel 6. This device, which basically is a hanger arrangement, includes a first hanger element 90, a second hanger element 92 and screws 94*a*-94*c*. The first hanger element 90 is attached to the panel 6 by means of a screw 94*a* at its lower part. A gap between the upper part of the first hanger element 90 and the panel 6 is formed. The second hanger element 92 is attached to the façade cladding 7 by means of a screw 94*b* at its lower part. Its upper part is in the shape of an upside down U which seizes the upper part of the first hanger element 90 extending from the gap between the panel 6 and the first hanger element 90 and around the upper part of the first hanger element 90. An additional screw 94*c* is provided to make sure that the first and second hanger elements 90, 92 are securely fixed to each other.

The hanger arrangement shown in FIG. 37 makes it possible to mount the façade cladding 7 to the facade panels 6 in a very efficient manner. The hanger elements 90, 92 are preferably elongated profiles, but they may also be shorter profiles or brackets (not shown). Owing to the hanger design, it is possible to easily replace façade claddings 7 by other types of external panels or elements if that is desired.

Figure 38:
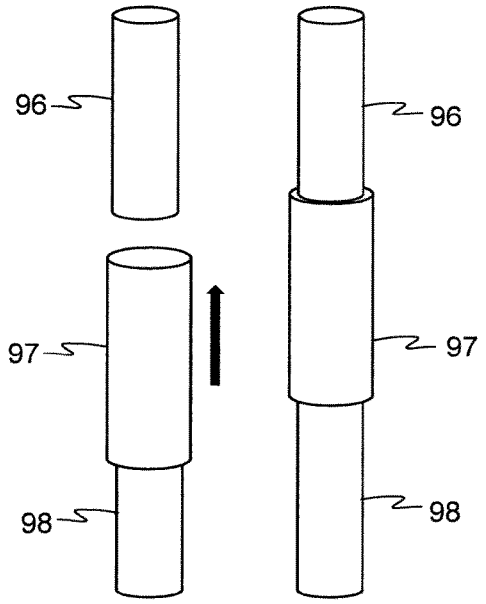
FIG. 38 shows connection of water supply pipes.
Figure 39:
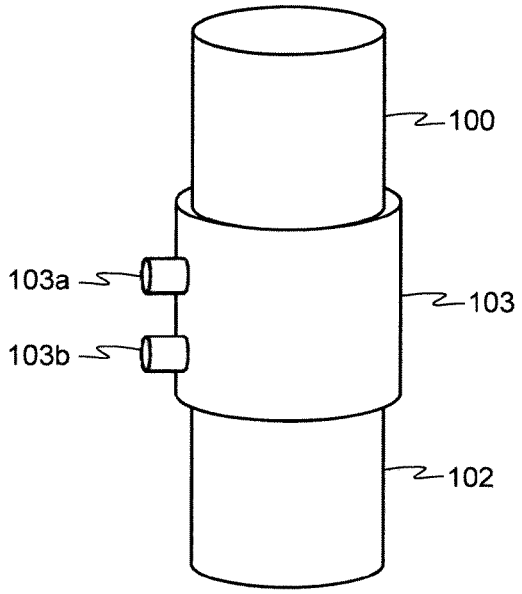
FIG. 39 shows connection of sewage pipes.
Figure 40:
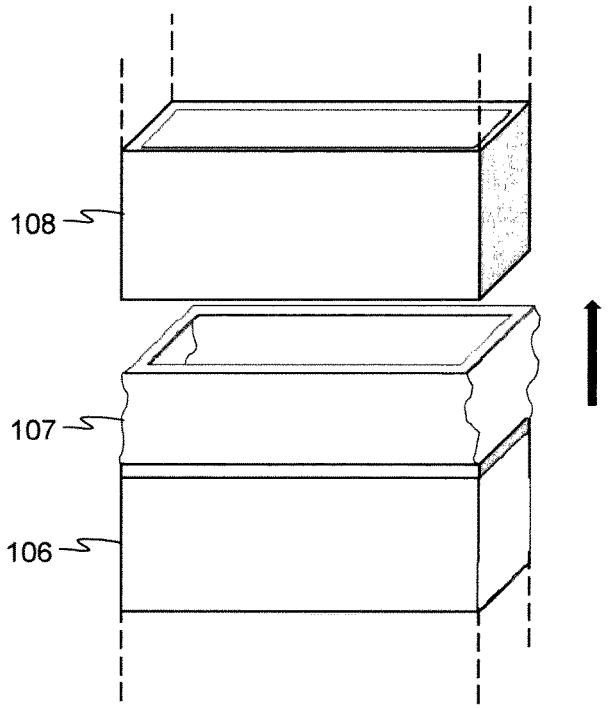
FIG. 40 shows connection of ventilation ducts.

As shown in FIGS. 38-40, the module 2 further includes three different supply assemblies. FIG. 38 shows a water pipe 96 extending from an upper module 2 and being attached to a water pipe 98 from a lower module 2 by means of a slideable tubular element 97. When connecting the two vertically aligned water pipes 96, 98, the tubular element 97 is pulled in the direction of the arrow, from the lower water pipe 98 to the upper water pipe 96. When the tubular element 97 spans the gap between the two water pipes 96, 98 the upper and lower end of the tubular element 97 will be crimped in place by means of a hand tool (not shown). Water connection between two modules 2 stacked on each other has thus been established. The pipes 96, 98 as well as the connecting element 97 may consist of metal, preferably stainless steel.

A similar technique is used for connecting two drain pipes 100, 102 between two modules 2, as is shown in FIG. 39. However, in this case the pipes 100, 102 as well as the connecting element 103 consist of plastics which means that the crimping of tubular connecting element 103 is performed by means of electricity. When the connecting element 103 spans the gap between the aligned drain pipes 100, 102, an electric current is applied to the element 103 via two sockets 103*a*, 103*b* whereby the diameter of the tube element 103 is decreased so that it is crimped and welded onto the aligned end portions of the drain pipes 100, 102. Drain water connection has been established between two vertically stacked modules 2.

FIG. 40 shows two vertically aligned ventilation ducts 106, 108 which extend between two modules 2 and where the lower ventilation duct 106 is provided with a flexible element 107 which may be pulled up toward the upper ventilation duct 108 where it will be attached by screws or other suitable fastening means (not shown). Thus, the gap between the two ventilation ducts 106, 108 is eliminated by the flexible element 107 and ventilation connection is established between the two stacked modules 2.

The supply arrangements shown in FIGS. 38-40 may be assembled at a service shaft of the module 2, namely in the space S and ventilation shaft 16 shown in FIG. 17. Easy access to the space S is provided by the opening to the corridor C. Further installations may be arranged in this service shaft, such as meters, control panels, etc.

Figure 41:
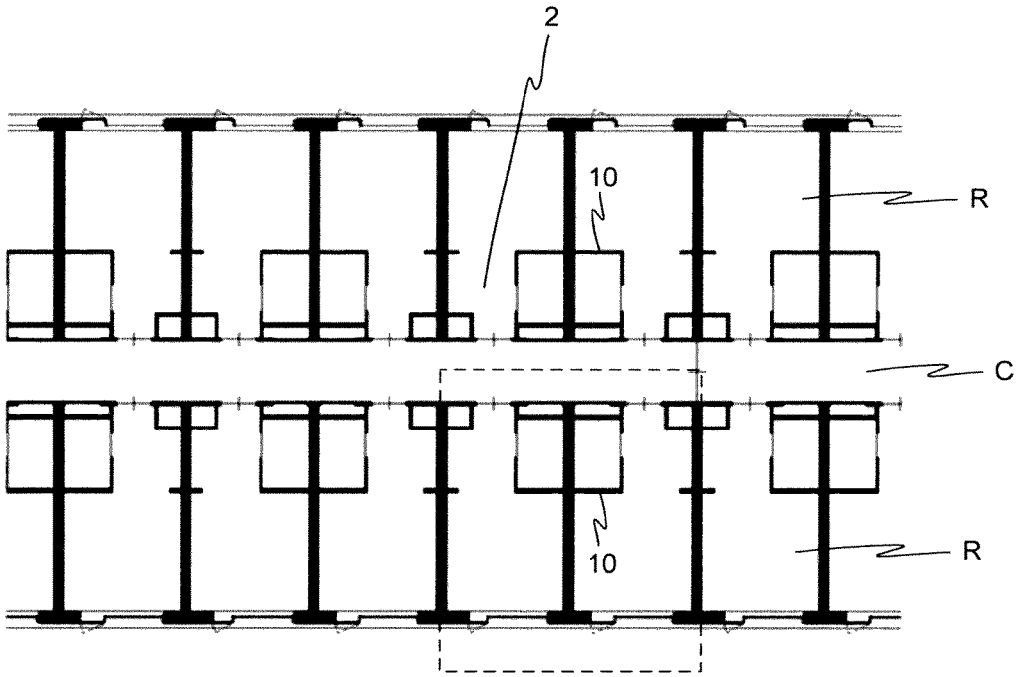
FIG. 41 shows a horizontal section of a building with a central corridor having aligned modules and rooms on either side.
Figure 42:
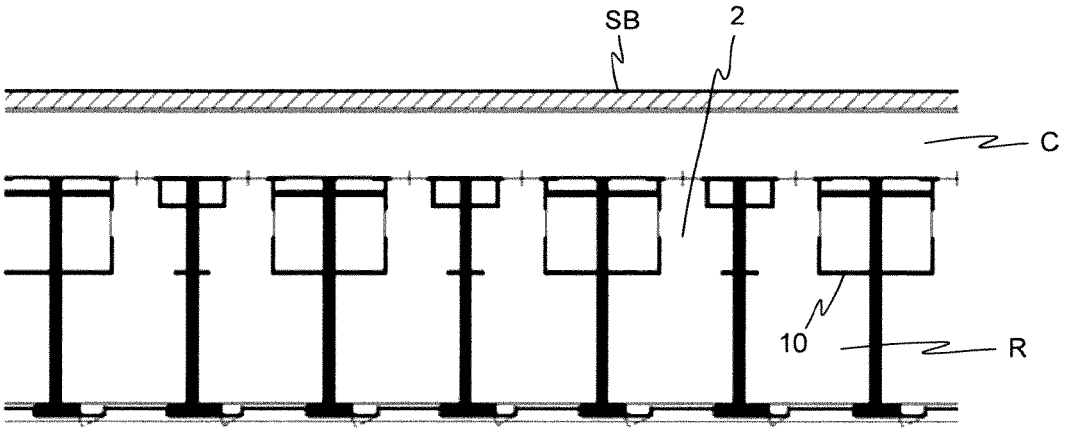
FIG. 42 shows a horizontal section of a building with a corridor having aligned modules and rooms only on one side.

The building B may be constructed in many different ways, and two alternatives are shown in FIGS. 41-42. FIG. 41 shows a layout with a corridor C in the centre and a set of similar rooms Ron both sides of the corridor C. On either side of the corridor C, the modules 2 form an array where the modules 2 of the opposite side of the corridor C are facing each other. The modules 2 are arranged in such a way that the bathrooms 10 of the two arrays are facing each other. The building then continues by the rooms R extending in a direction away from the corridor C.

FIG. 42 shows an alternative layout where there is only one array of rooms R next to the corridor C. Instead of the other array of rooms R a sound barrier SB is provided. This is an advantage when the building is situated close to a noisy area, e.g. a highway.

As well as there are different layouts of the overall building B there are also different layouts of the rooms R, especially the modules 2.

Figure 43A:
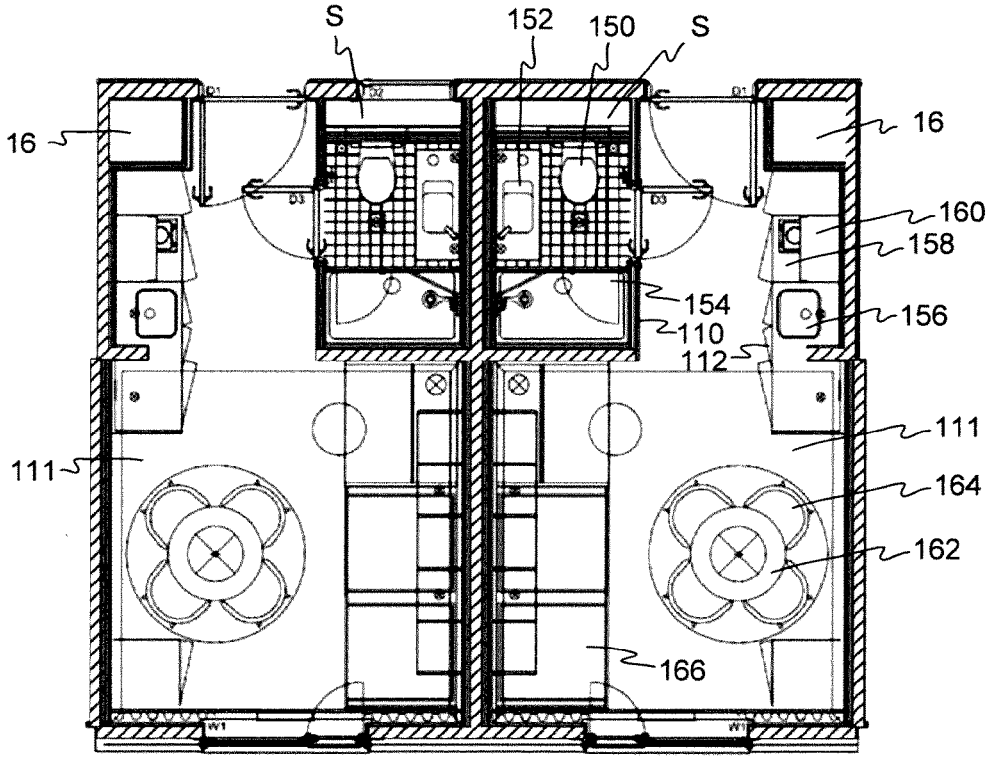
FIG. 43A shows from above two student rooms of a building in accordance with an embodiment of the inventive concept.

FIG. 43A shows two similar rooms 111 configured to be used as student homes. Each room 111 has a wet area compartment which includes a bathroom 110 and a kitchenette 112. The bathroom 110 is fully equipped with a water closet 150, a sink 152, a shower cabin 154, etc. The surfaces of the bathroom 110 fulfill waterproof requirements and the like. The same goes for the kitchenette 12 which is equipped with a sink 156, cooking facilities such as hot plates 158, cupboards 160, etc. The so-called wet area is ready to use from the outset. All installations of the module 2 related to wet area requirements are made at the prefabrication site which makes it easy to secure quality control, etc.

The panel-built part of the student home may be fully furnished with furniture after construction, for instance a table 162, chairs 164, a bed 166, etc. In order to keep costs low, the furniture may be standardized.

Figure 43B:
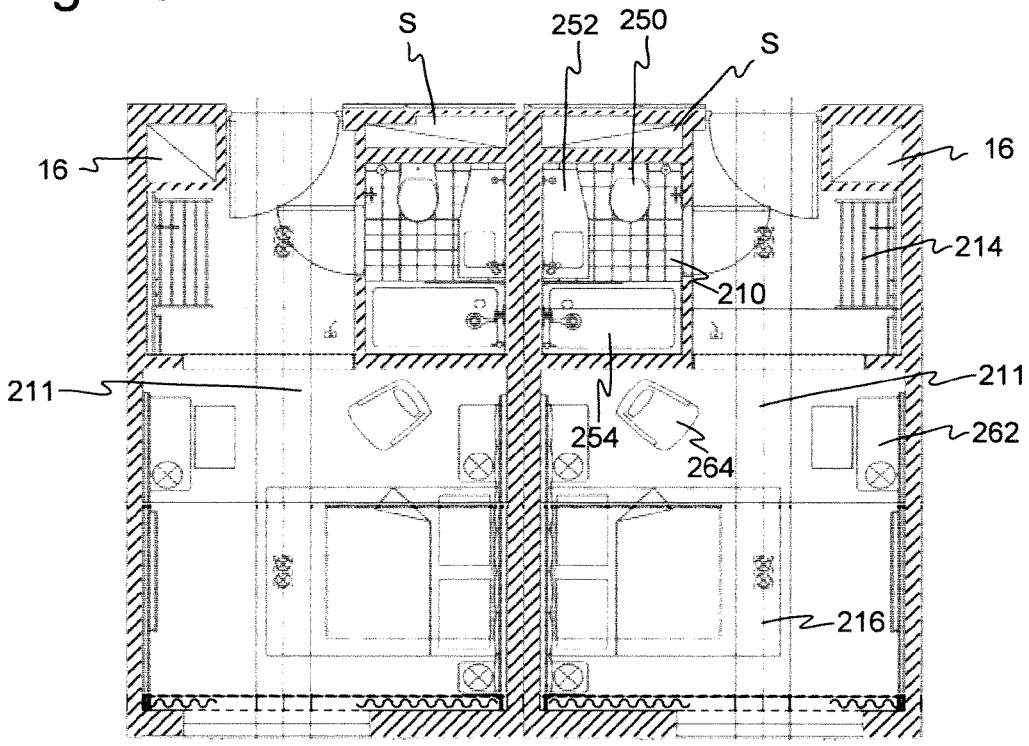
FIG. 43B shows from above two hotel rooms of a building in accordance with an embodiment of the inventive concept.

FIG. 43B shows two slightly different rooms 211 configured to be used in a hotel. Each room has a bathroom 210 which may be similar to the student home bathroom 110, that is with a water closet 250, a sink 252, a shower cabin 254, etc. However, the kitchenette has been replaced by coat hangers and/or wardrobes 214. A hotel room may e.g. be furnished with a large bed 216, a table 262 and chairs 264, as well as other light installations, air conditioning, sprinkler systems, etc (not shown).

Figure 43C:
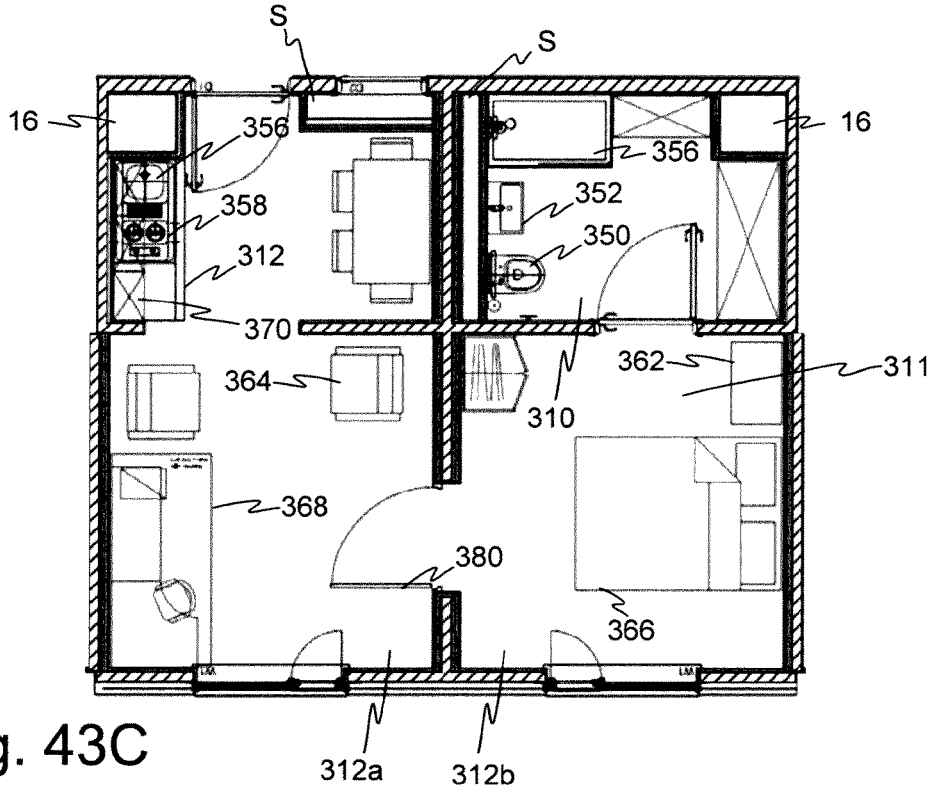
FIG. 43C shows from above a family room of a building in accordance with an embodiment of the inventive concept.

In FIG. 43C there is shown a third type of room 311 designed as a family room which is twice as big as the student and hotel rooms 111, 211 described above. The main difference is that there is a door 380 which provides mutual access to both compartments 312*a* and 312*b* of the room. The bathroom 310 is larger but contains the same basic equipment, namely a water closet 350, a sink 352 and a shower cabin 356. The kitchenette is expanded to a larger kitchen 312 with an eating area, but the kitchen equipment remains basically the same (sink 356, cooking means 358 and cupboards 370). The furniture of the panel-built part of the family room 311 may include at least a table 362, chairs 364 and at least one bed 366. Depending on the number of guests of the family room 311, there may be an additional bed 368 in one of the compartments.

Figure 43D:
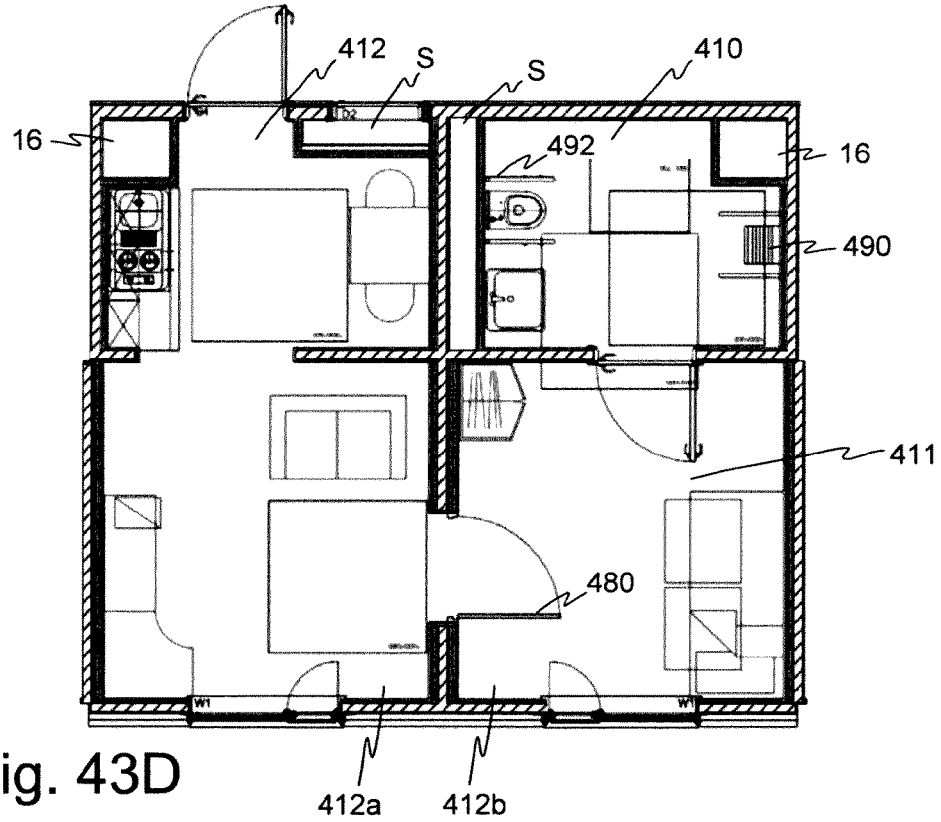
FIG. 43D shows from above a room for a disabled person included in a building in accordance with an embodiment of the inventive concept.

A fourth example of a room 411 is shown in FIG. 43D which is configured to give enough space for a disabled person. Similar to the family room 311, the module 2 has been modified so that the room 411 is twice as big as a student room 111 or a hotel room 211. The module area 2 now contains a large bathroom 410 and a large kitchen area 412. A door 480 provides access between the two compartments 412*a*, 412*b* of the room 411.

The bathroom 410 of this type of room 411 is adapted for a disabled person and it comprises special equipment 490, 492 for this purpose. In the same manner, the kitchen area 412 may include certain special equipment not described in detail here. Further modifications have been made in order to facilitate for a disabled person to move a wheelchair within the room. Hence, door hinges have been switched and in an embodiment not shown here it is also feasible that the door openings are made somewhat wider in order to give room for wheelchair movements.

Figure 44:
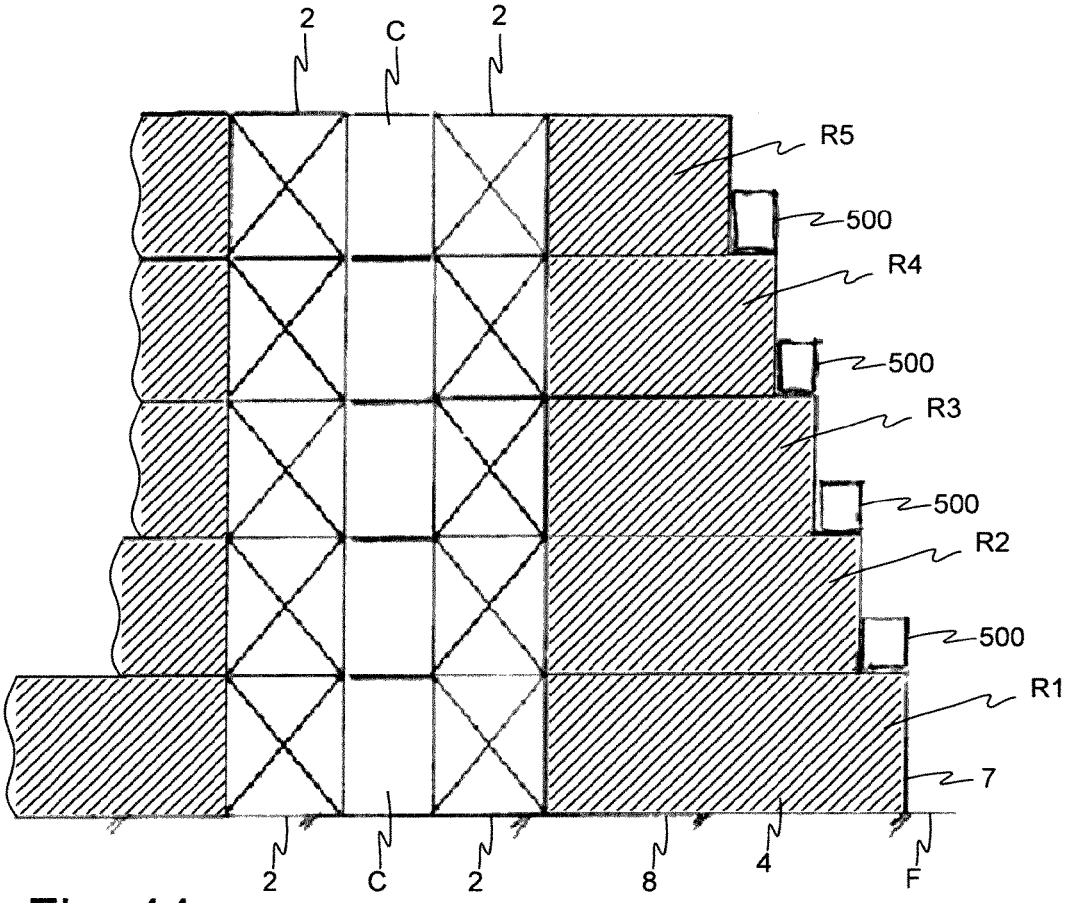
FIG. 44 shows in a side view how a building according to an embodiment of the inventive concept can have rooms of different sizes depending on the size of the wall panels used.

FIG. 44 is a schematic side view of an alternative building where the rooms R of rectangular cuboid shape have different sizes depending on where in the building they are located. The biggest rooms R1 are on the ground floor and as you move up the rooms R2-R5 get smaller. The rooms R2-R5 on the first floor or above have balconies 500 mounted to the roof of the floor below. The arrangement of the wet boxes 2, each of which having a rectangular cuboid shape, and the corridor C extending therebetween is the same for this type of building as for the buildings B shown in FIGS. 1-13. The difference lies in the size of the panel-built rooms R1-R5, which size is easily modified by using wall panels 6 of different length. Of course slabs 8 of corresponding dimensions need to be used. However, the facade panels 6 and the facade cladding 7 can be the same as in the buildings previously described. It should also be mentioned that the same static and dynamic connecting devices can be used when constructing a building of the type shown in FIG. 44.

It is to be appreciated that the inventive concept is by no means limited to the embodiments described herein, and many modifications are feasible within the scope of the invention set forth in the appended claims. For instance, other materials can be used for the elements included in the building constructions. Furthermore, other connection means can be used as long as reliable joining of the elements is achieved.

The invention claimed is:

1. A method for providing at least a part of a building, comprising the steps of:

(a) prefabricating a module by;

(i) assembling four module walls extending between a floor and a roof to form a rectangular cuboid shape, each of said four module walls comprises a frameless planar wooden core providing the four module walls with load-bearing properties, wherein the module comprises at least one compartment within the cuboid shape, the compartment being defined by the floor and the roof and interior wall surfaces;

(ii) providing waterproof layers on the interior wall surfaces and the floor defining the compartment and forming a wet area within said module;

(iii) arranging technical installations within said cuboid shape;

(iv) providing interior equipment within said cuboid shape;

(v) providing the module with engagement means for engagement with prefabricated panels or slabs or other prefabricated modules by means of connecting devices; and (vi) providing a service space on top of or at a bottom of the module by assembling said four walls extending between said floor and said roof such that upper edges of said four walls extend beyond an outer surface of the roof, or such that lower edges of said four walls extend beyond an outer surface of the floor, said service space providing access to a coupling means end of at least one of the technical installations;

(b) prefabricating a plurality of panels and slabs, each being constructed as a load-bearing structure and provided with engagement means for engagement with the module or other panel or slab by means of the connecting devices; and (c) connecting said plurality of panels and slabs to a lateral side of said module, by the engagement means and the connecting devices, for providing said part of a building such that said lateral side of said module together with said plurality of prefabricated panels and slabs form a further rectangular cuboid shape, wherein said module and said plurality of panels are constructed to support at least one module and plurality of prefabricated panels located thereabove.

2. The method according to claim 1, wherein the step of prefabricating the module further comprises providing interior partition walls for forming at least two compartments within the cuboid shape.

3. The method according to claim 2, wherein the step of providing interior partition walls is performed such that two separated compartments are formed, and wherein each one of said compartments is ready to be occupied by its own resident.

4. The method according to claim 3, wherein the interiors of the two separated compartments are symmetrical along a centre line of said module.

5. The method according to claim 1, wherein the module is prefabricated with dimensions of approximately 6.5-7.0 m in length, about 2.5 m in depth, and about 3.0 m in height.

6. The method according to claim 1, further comprising the step of providing said four module walls, floor, roof, panels and/or slabs by arranging the planar wooden core adjacent to at least one insulating layer for each one of said module walls, roof, floor, panels and/or slabs.

7. The method according to claim 6, wherein the planar wooden core is formed by cross-laminated timber.

8. The method according to claim 6, further comprising the step of providing at least one of said insulating layers as a multi-layer structure comprising an inner layer of acoustic damping material and/or fire resistant material, and an outer layer.

9. The method according to claim 8, wherein the multi-layer structure further comprises a heat insulation material.

10. The method according to claim 8, wherein the outer layer comprises gypsum board.

11. The method according to claim 6, further comprising the step of providing hollow electrical cable guides within said panels and/or slabs.

12. The method according to claim 1, wherein the step of prefabricating the module by assembling four module walls extending between a floor and a roof is performed such that the upper edges of said four module walls extend beyond an outer surface of the roof when the module walls and the roof are in an assembled position.

13. The method according to claim 1, wherein the step of prefabricating the module by assembling four module walls extending between a floor and a roof is performed such that the lower edges of said four module walls extend beyond an outer surface of the floor when the module walls and the floor are in an assembled position.

14. The method according to claim 1, further comprising providing at least one opening on at least one of the four module walls forming a part of the further rectangular cuboid shape, and at least one opening on the opposite module wall of said module.

15. The method according to claim 14, wherein the openings being provided with doors.

16. The method according to claim 1, wherein the step of providing waterproof layers for creating said wet area within said module is performed by covering at least a part of the interior sides of said walls and slabs with said waterproof interior layers.

17. The method according to claim 1, wherein the step of providing waterproof interior layers for creating said wet area within said module is performed by covering the complete interior sides of said walls and slabs with said waterproof interior layers.

18. The method according to claim 1, wherein the step of providing waterproof interior layers is performed by applying solid layers.

19. The method according to claim 1, wherein the step of providing waterproof interior layers is performed by applying liquid layers.

20. The method according to claim 1, wherein the step of arranging technical installations within said cuboid shape comprises arranging at least one ventilation duct, at least one mains electricity cable, at least one low voltage electrical cable, at least one water supply pipe, and at least one water sewage pipe within said module.

21. The method according to claim 20, wherein the step of arranging technical installations further comprises arranging a water-based heating system, and/or a cooling system, and/or a sprinkler system.

22. The method according to claim 20, wherein when the module walls and the roof are in an assembled position, upper edges of the four module walls extend beyond an outer surface of the roof forming an area above the roof, or lower edges of the four module walls extend beyond an outer surface of the floor forming an area below the floor, and wherein one end of at least one technical installation is accessible in the area formed above the roof of said module or in the area formed below the floor of said module.

23. The method according to claim 20, wherein said at least one ventilation duct extends within a first shaft extending along a wall of the module.

24. The method according to claim 23, wherein the at least one mains electricity cable, the at least one low voltage electrical cable, the at least one water supply pipe, and the at least one water sewage pipe extend within a second shaft extending along a wall of the module.

25. The method according to claim 24, wherein said first and second shafts are formed as a common space.

26. The method according to claim 20, wherein the at least one low voltage electrical cable is connected to at least one distribution board.

27. The method according to claim 1, wherein the step of providing at least one compartment is performed such that two major compartments are formed, and at least one shaft is formed for said technical installations.

28. The method according to claim 1, wherein the step of providing interior equipment within said cuboid shape comprises installing a bathroom in the module.

29. The method according to claim 1, wherein the step of providing interior equipment within said cuboid shape comprises installing a kitchenette in the module.

30. The method according to claim 1, wherein the step of providing interior equipment within said cuboid shape comprises installing furniture and/or fixtures in the module.

31. The method according to claim 1, further comprising the step of providing said module with at least one engagement element capable of engagement with a prefabricated panel or slab or another prefabricated module by means of a connecting device.

32. The method according to claim 1, further comprising the step of providing said panels and slabs with at least one engagement element capable of engagement with a prefabricated module or another prefabricated panel or slab by means of a connecting device.

33. The method according to claim 1, wherein the step of connecting said plurality of panels and slabs to a lateral side of said module is performed by connecting a first wall to one lateral side edge of said module, a second wall to another lateral side edge of said module, a third wall to a center portion of the lateral side of said module, a first floor slab to the first and third wall, a second floor slab to the second and third wall, a fourth wall to free lateral edge portions of the first and third walls, respectively, a fifth wall to free lateral edge portions of the second and third walls, respectively, a first roof slab to free upper edge portions of the first and third walls, respectively, and a second roof slab to free upper edge portions of the second and third walls, respectively.

34. The method according to claim 33, wherein said fourth wall and said fifth wall are formed as one piece.

35. The method according to claim 33, wherein said fourth wall and/or said fifth wall is formed as one piece with another wall arranged vertically aligned in the same plane with said fourth and/or fifth wall.

36. The method according to claim 1, wherein the step of connecting said plurality of panels and slabs to a lateral side of said module comprises providing at least one static connector and at least one dynamic connector for connecting at least one of said panels and/or slabs to said module.

37. The method according to claim 1, further comprising the step of connecting at least two prefabricated modules to each other in the direction of the length of the modules.

38. The method according to claim 1, further comprising the step of connecting at least two prefabricated modules to each other in the direction of the height of the modules.

39. The method according to claim 38, further comprising the step of aligning a first module with an adjacent module by means of alignment recesses provided on the upper edge portion of said first module and corresponding alignment protrusions on the bottom edge portion of said adjacent module.

40. A part of a building, comprising;

(a) a prefabricated module having a rectangular cuboid shape formed by four module walls extending between a floor and a roof, each of the four module walls comprises a frameless wooden core providing the four module walls with load-bearing properties, and comprises:

(i) at least one compartment within said cuboid shape, the compartment being defined by the floor and the roof and interior wall surfaces;

(ii) waterproof interior layers on the interior wall surfaces and the floor defining the compartment having a wet area within said cuboid shape;

(iii) technical installations within said cuboid shape;

(iv) interior equipment within said cuboid shape;

(v) the module having engagement means for engagement with prefabricated panels or slabs or other prefabricated modules by means of connecting devices; and (vi) a service space on top of or at a bottom of the module provided by said four walls extending between said floor and said roof such that upper edges of said four walls extend beyond an outer surface of the roof, or such that lower edges of said four walls extend beyond an outer surface of the floor, said service space providing access to a coupling means end of at least one of the technical installations;

(b) a plurality of prefabricated panels and slabs, each being constructed as a load-bearing structure and provided with engagement means for engagement with the module or other panel or slab by means of the connecting devices, connected to a lateral side of said module, by the engagement means and the connecting devices, such that said lateral side of said module together with said plurality of prefabricated panels and slabs form a further rectangular cuboid shape, wherein said module and said plurality of panels are constructed to support at least one module and plurality of prefabricated panels located thereabove.

41. The part of the building according to claim 40, wherein a core material of said module walls, floor, roof, panels, and slabs provides a load bearing structure.

42. The part of the building according to claim 40, wherein the technical installations within said module comprise at least one ventilation duct, at least one mains electricity cable, at least one low voltage electrical cable optionally connected to a at least one distribution board, at least one water supply pipe, and at least one water sewage pipe.

43. The part of the building according to claim 40, wherein said interior equipment within said module comprises a bathroom and/or a kitchenette and/or a wardrobe or a coat hanger.

44. The part of the building according to claim 40, wherein said panels and slabs and/or said prefabricated module comprise at least one engagement element capable of engagement with a prefabricated panel or slab or another prefabricated module by means of a connecting device.

45. The part of the building according to claim 44, wherein said connecting device comprises at least one static connector and at least one dynamic connector.

46. The part of the building according to claim 44, wherein said static connector and said dynamic connector are integrated in a combined connecting unit.

47. A multi-room building comprising a corridor extending horizontally, and at least a first part of a building according to claim 40 arranged on a first side of said corridor, and a second part of a building according to claim 40 arranged on the opposite side of said corridor, wherein said second part of the building is aligned with the first part of the building.

48. The multi-room building according to claim 47, further comprising additional parts of a building arranged on top of the parts of the building already provided such that a part of a building of a specific floor is vertically aligned with the underlying part of the building.

49. The part of a building of claim 40, wherein the prefabricated module is constructed as a load-bearing structure, and wherein each of the plurality of prefabricated panels and slabs are constructed as load-bearing structures comprising a core element.

50. A method for providing a building, comprising the steps of:

(a) prefabricating a plurality of modules, each of which by:

(i) assembling four module walls extending between a floor and a roof to form a rectangular cuboid shape, each of the four module walls comprises a frameless wooden core providing the four module walls with load-bearing properties, wherein the module is constructed as a load-bearing structure and comprises at least one compartment within the cuboid shape, the compartment being defined by the floor and the roof and interior wall surfaces;

(ii) providing waterproof layers on the interior wall surfaces and the floor defining the compartment and forming a wet area within said module;

(iii) arranging technical installations within said cuboid shape;

(iv) providing interior equipment within said cuboid shape;

(v) providing the module with engagement means for engagement with prefabricated panels or slabs or other prefabricated modules by means of connecting devices; and (vi) providing a service space on top of or at a bottom of the module by assembling said four walls extending between said floor and said roof such that upper edges of said four walls extend beyond an outer surface of the roof, or such that lower edges of said four walls extend beyond an outer surface of the floor, said service space providing access to a coupling means end of at least one of the technical installations;

(b) prefabricating a plurality of panels and slabs, each being constructed as a load-bearing structure and provided with engagement means for engagement with the module or other panel or slab by means of the connecting devices;

(c) positioning at least a part of said plurality of modules in a horizontal array such that at least one module wall of a module is arranged in close proximity to one module wall of an adjacent module; and (d) for each module connecting at least a part of said plurality of panels and slabs to a lateral side of said module, by the engagement means and the connecting devices, for providing a part of a building such that one module wall of each module together with said connected prefabricated panels and slabs form a further rectangular cuboid shape, wherein said module and said plurality of panels are constructed to support at least one module and plurality of prefabricated panels located thereabove.

51. The method according to claim 50, wherein the step of distributing said modules is performed by arranging a first module at a central position, and subsequently extending the horizontal array in at least one direction from said first module.

52. The method according to claim 51, further comprising arranging a second module in parallel with said first module at a predetermined distance, and extending a horizontal array in at least one direction from said second module such that said horizontal arrays are aligned to each other.

53. The method according to claim 52, further comprising the step of aligning a further module relative the first or second module by aligning protrusions and corresponding recesses provided on the further module and the first or second module, respectively.

54. The method according to claim 51, wherein the step of extending the horizontal array of modules is performed in at least two directions.

55. The method according to claim 54, wherein the step of connecting at least a part of said plurality of panels and slabs to a lateral side of each module is performed in said at least two directions of the horizontal array.

56. The method according to claim 51, further comprising the step of providing façade cladding on the outer surface of said module and/or panels.

57. The method according to claim 51, wherein the step of extending the horizontal array of modules is performed in at least two directions.

58. The method according to claim 50, further comprising the step of positioning additional modules in a vertical array from said first and/or second module such that said vertical array corresponds to several floors of a multi-resident building.

59. The method according to claim 58, wherein the step of positioning at least a part of said plurality of modules in a horizontal array is performed for several floors simultaneously.

60. The method according to claim 58, wherein the step of connecting at least a part of said plurality of panels and slabs to a lateral side of each module is performed simultaneously for at least two modules of the vertical array.

61. The method according to claim 50, wherein the step of connecting at least a part of said plurality of panels and slabs to a lateral side of each module is performed for at least two modules simultaneously.

62. A kit of building components, comprising at least one prefabricated module having a rectangular cuboid shape formed by four module walls extending between a floor and a roof, each of the four module walls comprises a frameless wooden core providing the four module walls with load-bearing properties, and comprises:

(i) at least one compartment within said cuboid shape defined by the floor and the roof and interior wall surfaces;

(ii) waterproof interior layers on the interior wall surfaces and the floor defining the compartment and providing a wet area within said cuboid shape, wherein optionally one or more of the walls comprises a module wall;

(iii) technical installations within said cuboid shape;

(iv) interior equipment within said cuboid shape; and (v) a service space on top of or at a bottom of the module provided by said four walls extending between said floor and said roof such that upper edges of said four walls extend beyond an outer surface of the roof, or such that lower edges of said four walls extend beyond an outer surface of the floor, said service space providing access to a coupling means end of at least one of the technical installations;

a plurality of prefabricated panels and slabs connectable to a lateral side of said module, the panels and slabs comprising at least one engagement element capable of engagement with another prefabricated panel or slab or another prefabricated module by means of one or more connecting devices, wherein said module and said plurality of prefabricated panels are constructed to support at least one module and plurality of panels located thereabove.

63. The kit of claim 62, wherein the one or more connecting devices comprise one or more static connectors and/or one or more dynamic connectors.

64. The kit of claim 62, wherein the module is constructed as a load-bearing structure, and wherein each of the plurality of prefabricated panels and slabs are constructed as load-bearing structures comprising a core element.

* * * * *